US010535335B2

(12) United States Patent
Mori et al.

(10) Patent No.: US 10,535,335 B2
(45) Date of Patent: Jan. 14, 2020

(54) VOICE SYNTHESIZING DEVICE, VOICE SYNTHESIZING METHOD, AND COMPUTER PROGRAM PRODUCT

(71) Applicants: Kabushiki Kaisha Toshiba, Minato-ku, Tokyo (JP); Toshiba Digital Solutions Corporation, Kawasaki-shi, Kanagawa (JP)

(72) Inventors: Kouichirou Mori, Kawasaki Kanagawa (JP); Yamato Ohtani, Kawasaki Kanagawa (JP)

(73) Assignees: Kabushiki Kaisha Toshiba, Tokyo (JP); Toshiba Digital Solutions Corporation, Kanagawa (JP)

( * ) Notice: Subject to any disclaimer, the term of this patent is extended or adjusted under 35 U.S.C. 154(b) by 0 days.

(21) Appl. No.: 15/256,220

(22) Filed: Sep. 2, 2016

(65) Prior Publication Data

US 2017/0076714 A1 Mar. 16, 2017

(30) Foreign Application Priority Data

Sep. 14, 2015 (JP) ..... 2015-181038

(51) Int. Cl.
*G10L 13/047* (2013.01)
*G10L 13/033* (2013.01)

(52) U.S. Cl.
CPC ..... *G10L 13/033* (2013.01)

(58) Field of Classification Search
CPC ..... G10L 13/033; G10L 13/04; G10L 13/08; G10L 13/02; G10L 13/10; G10L 13/00;
(Continued)

(56) References Cited

U.S. PATENT DOCUMENTS 5,860,064 A * 1/1999 Henton ..... G10L 13/033 204/266
6,226,614 B1 5/2001 Mizuno et al.
(Continued)

FOREIGN PATENT DOCUMENTS

JP H 10-254473 A 9/1998
JP H 11-015488 A 1/1999
(Continued)

OTHER PUBLICATIONS

Tachibana, M., et al., "A Technique for Controlling Voice Quality of Synthetic Speech Using Multiple Regression HSMM", in Proc. INTERSPEECH2006, pp. 2438-2441, 2006.
(Continued)

*Primary Examiner* — Richemond Dorvil
*Assistant Examiner* — Mark Villena
(74) *Attorney, Agent, or Firm* — Knobbe, Martens, Olson & Bear, LLP

(57) ABSTRACT

According to one embodiment, a voice synthesizing device includes a first operation receiving unit, a score transforming unit, and a voice synthesizing unit. The first operation receiving unit configured to receive a first operation specifying voice quality of a desired voice based on one or more upper level expressions indicating the voice quality. The score transforming unit configured to transform, based on a score transformation model that transforms a score of the upper level expression into a score of a lower level expression which is less abstract than the upper level expression, the score of the upper level expression corresponding to the first operation into a score of one or more lower level expressions. The voice synthesizing unit configured to generate a synthetic sound corresponding to a certain text based on the score of the lower level expression.

15 Claims, 23 Drawing Sheets

(58) Field of Classification Search
CPC ..... G10L 13/06; G10L 15/26; G10L 13/0335; G10L 13/043; G10L 13/027; G10L 15/18; G10L 13/047; G10L 2015/0638; G10L 2021/0135; G10L 21/003; G10L 25/90
See application file for complete search history.

(56) References Cited

U.S. PATENT DOCUMENTS 6,334,106 B1 12/2001 Mizuno et al.
7,457,752 B2 * 11/2008 Oudeyer ..... G10L 13/033 700/1
8,155,964 B2 4/2012 Hirose et al.
2002/0198717 A1 * 12/2002 Oudeyer ..... G10L 21/06 704/270
2003/0093280 A1 * 5/2003 Oudeyer ..... G10L 13/033 704/266
2004/0107101 A1 * 6/2004 Eide ..... G10L 13/10 704/260
2004/0186720 A1 * 9/2004 Kemmochi ..... G10H 5/00 704/258
2009/0234652 A1 * 9/2009 Kato ..... G10L 13/033 704/260
2009/0254349 A1 * 10/2009 Hirose ..... G10L 13/033 704/260
2012/0191460 A1 * 7/2012 Ng-Thow-Hing ..... G10L 21/10 704/272
2013/0054244 A1 * 2/2013 Bao ..... G10L 13/10 704/260
2013/0066631 A1 * 3/2013 Wu ..... G10L 13/08 704/258
2014/0067397 A1 * 3/2014 Radebaugh ..... G10L 13/08 704/260
2015/0058019 A1 * 2/2015 Chen ..... G10L 13/02 704/260
2015/0073770 A1 * 3/2015 Pulz ..... G10L 13/086 704/3
2015/0149178 A1 * 5/2015 Kim ..... G10L 13/10 704/260
2015/0179163 A1 * 6/2015 Conkie ..... H04B 7/0404 704/260
2016/0027431 A1 * 1/2016 Kurzweil ..... G06F 3/04842 715/203
2016/0078859 A1 * 3/2016 Luan ..... G10L 13/033 704/260
2016/0365087 A1 * 12/2016 Freud ..... G10L 13/10

FOREIGN PATENT DOCUMENTS

JP H 11-103226 A 4/1999
JP H 11-202884 A 7/1999
JP 2007-148039 A 6/2007
JP 4296231 B2 7/2009
JP 4745036 B2 8/2011

OTHER PUBLICATIONS

Huang, C-F., et al., "A three-layered model for expressive speech perception," Speech Communication, 50, pp. 810-828, 2008.

* cited by examiner

FIG.4

212 213 211

| SPEAKER ID | SEX | AGE | HEIGHT | SPEED | CHEER-FULNESS | HARD-NESS | FLUENT-NESS |
|---|---|---|---|---|---|---|---|
| M001 | -3.48 | -0.66 | -0.88 | -0.34 | 1.36 | 0.24 | 1.76 |
| M002 | -4.34 | 0.29 | -3.28 | -0.20 | -2.04 | 1.80 | -0.02 |
| M003 | -0.32 | -4.12 | 2.04 | -3.10 | 1.62 | -1.20 | -3.00 |
| F001 | 3.32 | -2.35 | 1.88 | 1.32 | 1.74 | -0.58 | 1.54 |
| F002 | 4.38 | -3.15 | 3.30 | 0.36 | 2.48 | -1.72 | 0.56 |
| F003 | 1.10 | -4.21 | 2.68 | -2.70 | 2.42 | -1.64 | -2.98 |
| ... | | | | | | | |

FIG.5

212 222 221

| SPEAKER ID | CALM | INTELLEC-TUAL | GENTLE | CUTE | ELEGANT | FRESH |
|---|---|---|---|---|---|---|
| M001 | 1.35 | 3.52 | 1.25 | -1.24 | 3.25 | 1.85 |
| M002 | 3.92 | 1.52 | -1.32 | -4.85 | 4.85 | -1.39 |
| M003 | -2.48 | -1.83 | 1.06 | 4.21 | -4.52 | 0.32 |
| F001 | 0.54 | 3.24 | 2.45 | -2.14 | -2.58 | 4.85 |
| F002 | -1.12 | 0.54 | 2.20 | 2.95 | -4.52 | 2.35 |
| F003 | -3.24 | -1.25 | 1.95 | 4.85 | -4.99 | 0.31 |
| ... | | | | | | |

VOICE SYNTHESIZING DEVICE, VOICE SYNTHESIZING METHOD, AND COMPUTER PROGRAM PRODUCT

CROSS-REFERENCE TO RELATED APPLICATIONS

This application is based upon and claims the benefit of priority from Japanese Patent Application No. 2015-181038, filed on Sep. 14, 2015; the entire contents of which are incorporated herein by reference.

FIELD

Embodiments described herein relate generally to a voice synthesizing device, a voice synthesizing method, and a computer program product.

BACKGROUND

With the recent development of voice synthesis technologies, high-quality synthetic sounds have been able to be generated. Voice synthesis technologies using the hidden Markov model (HMM) are known to flexibly control a synthetic sound with a model obtained by parameterizing voices. Technologies for generating various types of synthetic sounds have been in practical use, including a speaker adaptation technology for generating a high-quality synthetic sound from a small amount of recorded voice and an emotional voice technology for synthesizing an emotional voice, for example.

Under the circumstances described above, synthetic sounds have been applied to a wider range of fields, such as reading out of electronic books, digital signage, dialog agents, entertainment, and robots. In such applications, a user desires to generate a synthetic sound not only of a voice of a speaker prepared in advance but also of a desired voice. To address this, there have been developed technologies of voice quality editing of changing parameters of an acoustic model of an existent speaker or generating a synthetic sound having the voice quality of a non-existent speaker by combining a plurality of acoustic models.

The conventional technologies of voice quality editing mainly change parameters themselves of an acoustic model or reflect specified characteristics of voice quality (e.g., a high voice and a voice of rapid speech) directly connected to the parameters of the acoustic model. The voice quality desired by a user, however, tends to be precisely expressed by a more abstract word, such as a cute voice and a fresh voice. As a result, there have been increasing demands for a technology for generating a synthetic sound having a desired voice quality by specifying the voice quality based on an abstract word.

BRIEF DESCRIPTION OF THE DRAWINGS

FIG. 4 is a diagram illustrating an example of score data of lower level expressions;

FIG. 5 is a diagram illustrating an example of score data of upper level expressions;

DETAILED DESCRIPTION

According to one embodiment, a voice synthesizing device includes a first operation receiving unit, a score transforming unit, and a voice synthesizing unit. The first operation receiving unit configured to receive a first operation specifying voice quality of a desired voice based on one or more upper level expressions indicating the voice quality. The score transforming unit configured to transform, based on a score transformation model that transforms a score of an upper level expression into a score of a lower level expression which is less abstract than the upper level expression, the score of the upper level expression corresponding to the first operation into the score of the lower level expression. The voice synthesizing unit configured to generate a synthetic sound corresponding to a certain text based on the score of the lower level expression.

Figure 1:
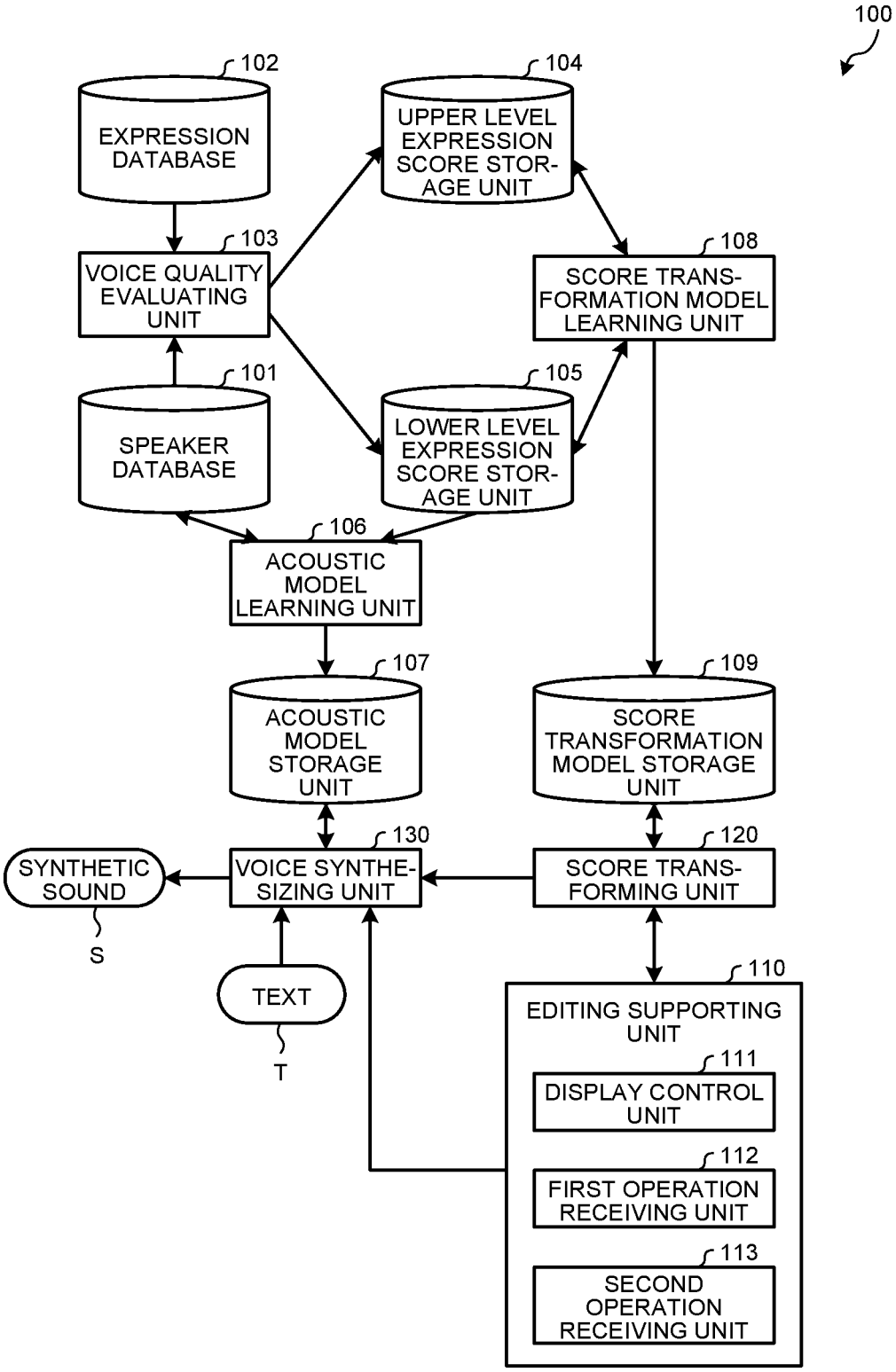
FIG. 1 is a block diagram illustrating an exemplary functional configuration of a voice synthesizing device according to a first embodiment.

First embodiment FIG. 1 is a block diagram illustrating an exemplary functional configuration of a voice synthesizing device 100 according to a first embodiment. As illustrated in FIG. 1, the voice synthesizing device 100 according to the present embodiment includes a speaker database 101, an expression database 102, a voice quality evaluating unit 103, an upper level expression score storage unit 104, a lower level expression score storage unit 105, an acoustic model learning unit 106, an acoustic model storage unit 107, a score transformation model learning unit 108, a score transformation model storage unit 109, an editing supporting unit 110, a score transforming unit 120, and a voice synthesizing unit 130.

The speaker database 101 is a storage unit that retains voices of a plurality of speakers required to learn an acoustic model, acoustic features extracted from the voices, and context labels extracted from character string information on the voices. Examples of the acoustic features mainly used for an existing HMM voice synthesis include, but are not limited to, mel-cepstrum, mel-LPC, and mel-LSP indicating a phoneme and a tone, a fundamental frequency indicating a pitch of a voice, an aperiodic index indicating the ratio of a periodic component to an aperiodic component of a voice, etc. The context label is linguistic characteristics obtained from the character string information on an output voice. Examples of the context label include, but are not limited to, prior and posterior phonemes, information on pronunciation, the position of a phrase end, the length of a sentence, the length of a breath group, the position of a breath group, the length of an accent phrase, the length of a word, the position of a word, the length of mora, the position of a mora, the accent type, dependency information, etc.

The expression database 102 is a storage unit that retains a plurality of expressions indicating voice quality. The expressions indicating voice quality according to the present embodiment are classified into upper level expressions and lower level expressions which are less abstract than the upper level expressions.

Figure 2:
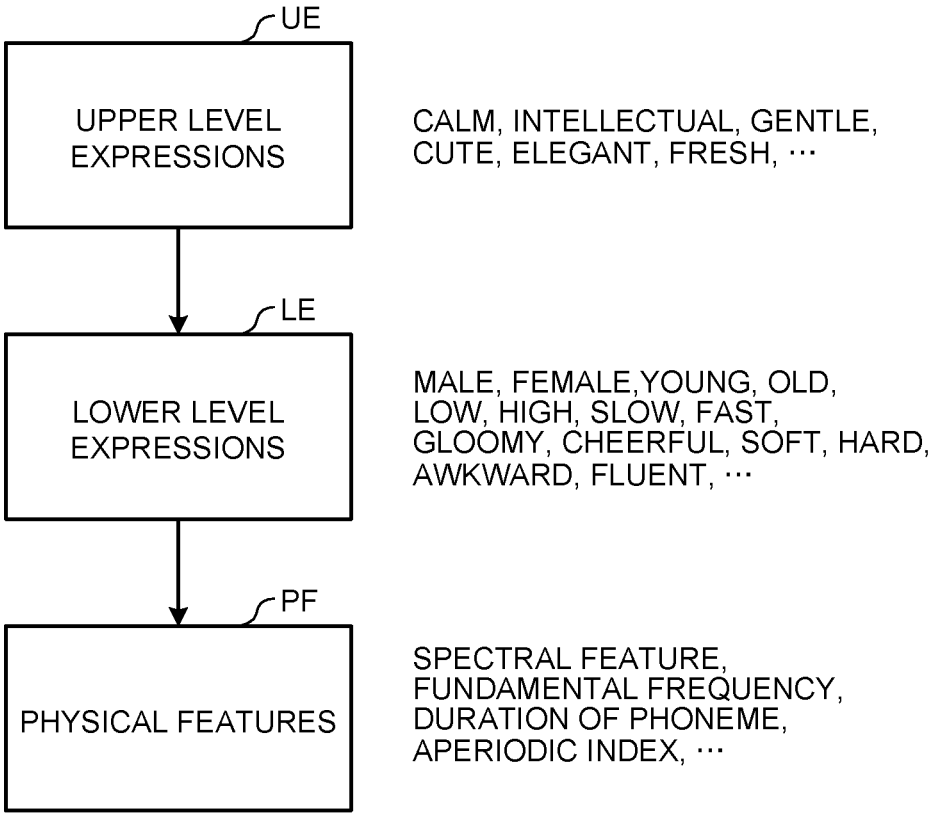
FIG. 2 is a diagram for explaining a level structure of expressions.

FIG. 2 is a diagram for explaining a level structure of expressions. Physical features PF correspond to parameters of an acoustic model, such as a spectral feature, a fundamental frequency, duration of a phoneme, and an aperiodic index. Lower level expressions LE correspond to words indicating specific voice qualities, such as male, female, young, old, low, high, slow, fast, gloomy, cheerful, soft, hard, awkward, and fluent, relatively closer to the physical features PF. Whether a voice is low or high relates to the fundamental frequency, and whether a voice is slow or fast relates to the duration of a phoneme and other elements, for example. The sex (male or female) and the age (young or old) indicate not an actual sex and an actual age of a speaker but the sex and the age assumed based on a voice. Upper level expressions UE correspond to words indicating more abstract voice qualities, such as calm, intellectual, gentle, cute, elegant, and fresh, than those of the lower level expressions LE. The voice qualities expressed by the upper level expressions UE according to the present embodiment are each assumed to be a combination of voice qualities expressed by the lower level expressions LE.

One of advantageous effects of the voice synthesizing device 100 according to the present embodiment is that a user can edit voice quality using the upper level expressions UE, which is more abstract and easier to understand, besides the lower level expressions LE closer to the physical features PF.

The voice quality evaluating unit 103 evaluates and scores characteristics of voice qualities of all the speakers stored in the speaker database 101. While various methods for scoring voice quality are known, the present embodiment employs a method of carrying out a survey and collecting the results. In the survey, a plurality of subjects listens to the voices stored in the speaker database 101 to evaluate the voice qualities. The voice quality evaluating unit 103 may use any method other than the survey as long as it can score the voice qualities of the speakers stored in the speaker database 101.

Figure 3A:
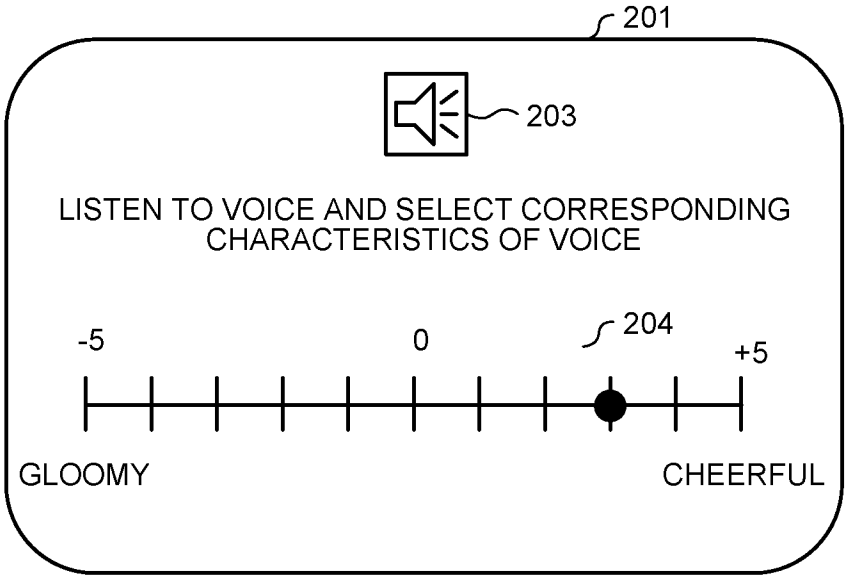
FIGS. 3A and 3B are schematics illustrating an example of interfaces for a questionnaire survey.
Figure 3B:
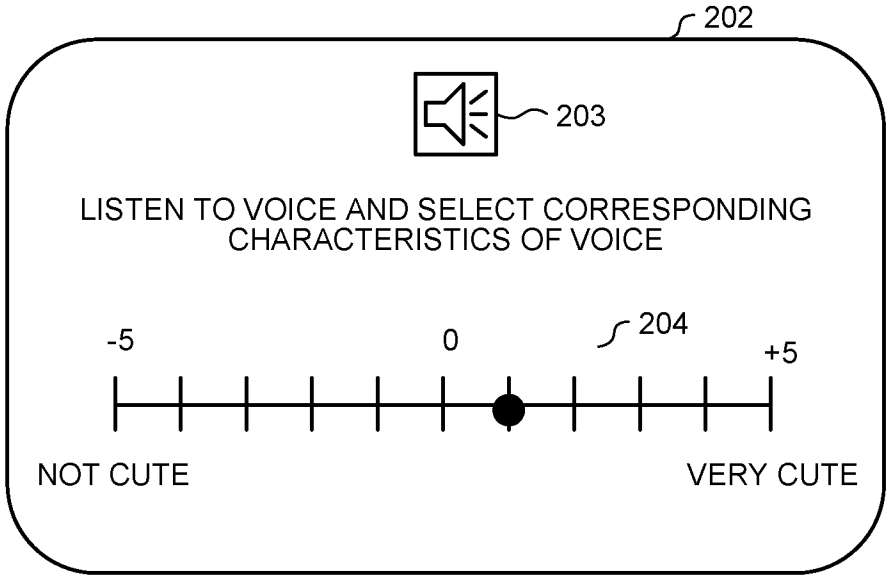

FIGS. 3A and 3B are schematics illustrating an example of interfaces for a questionnaire survey. In the survey, characteristics of voices are evaluated not only with the lower level expressions LE using an interface 201 illustrated in FIG. 3A but also with the upper level expressions UE using an interface 202 illustrated in FIG. 3B. A subject operates a reproduction button 203 to listen to the voices of the respective speakers stored in the speaker database 101. The subject is then required to evaluate the characteristics of the voices on a scale 204 of expressions retained in the expression database 102 within a range of −5 to +5. The characteristics of the voices are not necessarily evaluated within a range of −5 to +5, and they may be evaluated within any range, such as a range of 0 to 1 and 0 to 10. While the sex can be scored by two values of male and female, it is scored within a range of −5 to +5 similarly to the other expressions. Specifically, −5 indicates a male voice, +5 indicates a female voice, and 0 indicates an androgynous voice (e.g., a child voice) hard to clearly determine to be a male voice or a female voice.

The voice quality evaluating unit 103, for example, collects the results of the survey described above. The voice quality evaluating unit 103 scores the voice qualities of all the speakers stored in the speaker database 101 using indexes of the lower level expressions LE and the upper level expressions UE, thereby generating score data.

The lower level expression score storage unit 105 retains score data of the lower level expressions LE generated by the voice quality evaluating unit 103. FIG. 4 is a diagram illustrating an example of score data of the lower level expressions LE stored in the lower level expression score storage unit 105. In the example illustrated in FIG. 4, a row 211 in the table indicates scores of the respective lower level expressions LE of one speaker. The rows 211 are each provided with a speaker ID 212 for identifying a speaker corresponding thereto. A column 213 in the table indicates scores of one lower level expression LE of the respective speakers. The score is the statistics (e.g., the average) of evaluation results obtained from a plurality of subjects. A vector viewing the data in the direction of the row 211, that is, a vector having the scores of the respective lower level expressions LE of one speaker as its elements is hereinafter referred to as a "lower level expression score vector". In the example illustrated in FIG. 4, the lower level expression score vector of the speaker having a speaker ID 212 of M001 is (−3.48, −0.66, −0.88, −0.34, 1.36, 0.24, 1.76). The dimensions of the lower level expression score vector correspond to the lower level expressions LE.

The upper level expression score storage unit 104 retains score data of the upper level expressions UE generated by the voice quality evaluating unit 103. FIG. 5 is a diagram illustrating an example of score data of the upper level expressions UE stored in the upper level expression score storage unit 104. While the score data has the same structure as that of the score data of the lower level expressions LE illustrated in FIG. 4, it does not retain the scores of the lower level expressions LE but the scores of the upper level expressions UE. In the score data illustrated in FIG. 5, a row 221 in the table indicates scores of the respective upper level expressions UE of one speaker, and a column 222 in the table indicates scores of one upper level expression UE of the respective speakers. Similarly to the lower level expression score vector, a vector viewing the data in the direction of the row 221, that is, a vector having the scores of the respective upper level expressions UE of one speaker as its elements is hereinafter referred to as an "upper level expression score vector". The dimensions of the upper level expression score vector correspond to the upper level expressions UE.

The acoustic model learning unit 106 learns an acoustic model used for a voice synthesis based on the acoustic features and the context labels retained in the speaker database 101 and on the score data of the lower level expressions LE retained in the lower level expression score storage unit 105. To learn the model, a model learning method called multiple regression hidden semi-Markov model (HSMM) can be applied without any change, which is disclosed in Makoto Tachibana, Takashi Nose, Junichi Yamagishi, and Takao Kobayashi, "A Technique for Controlling Voice Quality of Synthetic Speech Using Multiple Regression HSMM", in Proc. INTERSPEECH2006, pp. 2438-2441, 2006. The multiple regression HSMM can be modeled by Equation (1) where μ is an average vector of an acoustic model represented by a normal distribution, ξ is the lower level expression score vector, H is a transformation matrix, and b is a bias vector.

$$\mu = H\xi + b$$

$$\xi = [v_1, v_2, \ldots, v_L] \quad (1)$$

L is the number of lower level expressions LE, and $v_i$ is a score of the i-th lower level expression LE. The acoustic model learning unit 106 uses the acoustic features and the context labels retained in the speaker database 101 and the score data of the lower level expressions LE retained in the lower level expression score storage unit 105 as learning data. The acoustic model learning unit 106 calculates the transformation matrix H and the bias vector b by maximum likelihood estimation based on the expectation-maximization (EM) algorithm. When the learning is finished, and the transformation matrix H and the bias vector b are estimated, a certain lower level expression score vector ξ can be transformed into the average vector μ of the acoustic model by Equation (1). This means that a synthetic sound having a certain voice quality represented by the lower level expression score vector ξ can be generated. The learned acoustic model is retained in the acoustic model storage unit 107 and used to synthesize a voice by the voice synthesizing unit 130.

While the multiple regression HSMM is employed as the acoustic model used for a voice synthesis in this example, the acoustic model is not limited thereto. Any model other than the multiple regression HSMM may be used as long as it maps a certain lower level expression score vector onto the average vector of the acoustic model.

The score transformation model learning unit 108 learns a score transformation model that transforms a certain upper level expression score vector into the lower level expression score vector based on the score data of the upper level expressions UE retained in the upper level expression score storage unit 104 and on the score data of the lower level expressions LE retained in the lower level expression score storage unit 105. Similarly to the multiple regression HSMM, a multiple regression model may be used as the transformation model. The score transformation model based on the multiple regression model can be modeled by Equation (2) where η is the upper level expression score vector, ξ is the lower level expression score vector, G is a transformation matrix, and d is a bias vector.

$$\xi = G\eta + d$$

$$\eta = [w_1, w_2, \ldots, w_M] \quad (2)$$

M is the number of upper level expressions UE, and $w_i$ is a score of the i-th upper level expression UE. The score transformation model learning unit 108 uses the score data of the upper level expressions UE retained in the upper level expression score storage unit 104 and the score data of the lower level expressions LE retained in the lower level expression score storage unit 105 as learning data. The score transformation model learning unit 108 calculates the transformation matrix G and the bias vector d by maximum likelihood estimation based on the EM algorithm. When the learning is finished, and the transformation matrix G and the bias vector d are estimated, a certain upper level expression score vector η can be transformed into the lower level expression score vector ξ. The learned score transformation model is retained in the score transformation model storage unit 109 and used to transform the upper level expression score vector into the lower level expression score vector by the score transforming unit 120, which will be described later.

While the multiple regression model is employed as the score transformation model in this example, the score transformation model is not limited thereto. Any score transformation model may be used as long as it is generated by an algorithm that learns mapping a vector onto another vector. A neural network or a mixture Gaussian model, for example, may be used as the score transformation model.

With the score transformation model and the acoustic model described above, the user simply needs to specify the upper level expression score vector. The specified upper level expression score vector is transformed into the lower level expression score vector using the score transformation model represented by Equation (2). Subsequently, the lower level expression score vector is transformed into the average vector μ of the acoustic model using the acoustic model represented by Equation (1). As a result, the voice synthesizing device 100 can generate a synthetic sound having a certain voice quality indicated by the upper level expression score vector. The voice synthesizing device 100 according to the present embodiment employs the mechanism of multi-stage transformation described above, thereby providing a new voice quality editing interface.

The voice synthesizing device 100 according to the present embodiment receives an operation to specify a desired voice quality based on one or more upper level expressions UE (hereinafter, referred to as a "first operation") performed by the user. The voice synthesizing device 100 transforms the upper level expression score vector corresponding to the first operation into the lower level expression score vector and exhibits the lower level expression score vector resulting from transformation to the user. If the user performs an operation to change the exhibited lower level expression score vector (hereinafter, referred to as a "second operation"), the voice synthesizing device 100 receives the second operation. Based on the lower level expression score vector resulting from transformation of the upper level expression score vector or the lower level expression score vector changed based on the second operation, the voice synthesizing device 100 generates a synthetic sound having a desired voice quality. The functional components that perform these functions correspond to the editing supporting unit 110, the score transforming unit 120, and the voice synthesizing unit 130.

The editing supporting unit 110 is a functional module that provides a voice quality editing interface characteristic of the voice synthesizing device 100 according to the present embodiment to support voice quality editing performed by the user. The editing supporting unit 110 includes a display control unit 111, a first operation receiving unit 112, and a second operation receiving unit 113 serving as sub modules. The display control unit 111 causes a display device to display an edit screen. The first operation receiving unit 112 receives the first operation input on the edit screen. The second operation receiving unit 113 receives the second operation input on the edit screen. Voice quality editing using the voice quality editing interface provided by the editing supporting unit 110 will be described later in detail with reference to a specific example of the edit screen.

The score transforming unit 120 transforms the upper level expression score vector corresponding to the first operation into the lower level expression score vector based on the score transformation model retained in the score transformation model storage unit 109. As described above, the acoustic model used to synthesize a voice by the voice synthesizing unit 130 transforms the lower level expression score vector into the average vector of the acoustic model. Consequently, the voice synthesizing unit 130 fails to synthesize a voice directly from the upper level expression score vector generated based on the first operation. To address this, it is necessary to transform the upper level expression score vector generated based on the first operation into the lower level expression score vector. The score transforming unit 120 transforms the upper level expression score vector into the lower level expression score vector. In the score transformation model retained in the score transformation model storage unit 109, the transformation matrix G and the bias vector d in Equation (2) are already estimated by the learning. Consequently, the score transforming unit 120 can transform the upper level expression score vector generated based on the first operation into the lower level expression score vector using the score transformation model retained in the score transformation model storage unit 109.

The voice synthesizing unit 130 uses the acoustic model (e.g., the multiple regression HSMM represented by Equation (1)) retained in the acoustic model storage unit 107 to generate a synthetic sound S corresponding to a certain text T. The voice synthesizing unit 130 generates the synthetic sound S having voice quality corresponding to the lower level expression score vector resulting from transformation of the upper level expression score vector or the lower level expression score vector changed based on the second operation. The synthetic sound S generated by the voice synthesizing unit 130 is output (reproduced) from a speaker. The method for synthesizing a voice performed by the voice synthesizing unit 130 is a voice synthesizing method using the HMM. Detailed explanation of the voice synthesizing method using the HMM is omitted herein because it is described in detail in the following reference, for example.

Reference 1: Keiichi Tokuda et al., "Speech Synthesis Based on Hidden Markov Models", Proceedings of the IEEE, 101(5), pp. 1234-1252, 2013.

Figure 6:
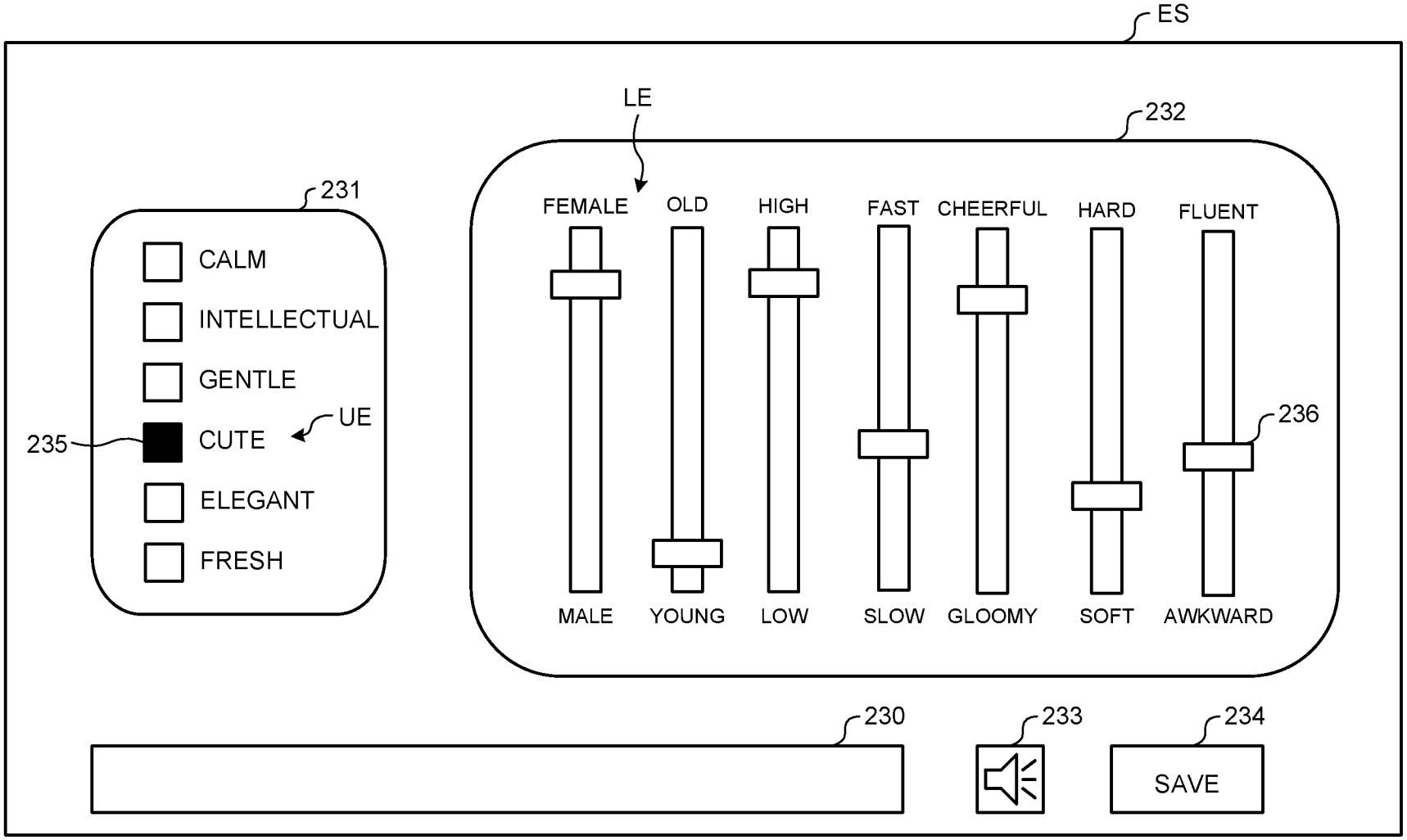
FIG. 6 is a schematic illustrating an example of an edit screen.

The following describes a specific example of voice quality editing using the voice quality editing interface which is characteristic in the voice synthesizing device 100 according to the present embodiment. FIG. 6 is a schematic illustrating an example of an edit screen ES displayed on the display device under the control of the display control unit 111. The edit screen ES illustrated in FIG. 6 includes a text box 230, a first area 231, a second area 232, a reproduction button 233, and a save button 234.

The text box 230 is an area to which the user inputs a certain text T to be a target of a voice synthesis.

The first area 231 is an area on which the user performs the first operation. While various formats that cause the user to perform the first operation are known, FIG. 6 illustrates the first area 231 of an option format, for example. In the first area 231 of an option format, a plurality of upper level expressions UE assumed in the present embodiment are displayed in line, and the user is caused to select one of them. The first area 231 illustrated in FIG. 6 includes check boxes 235 corresponding to the respective upper level expressions UE. The user selects a check box 235 of the upper level expression UE most precisely expressing the voice quality of a to-be-generated synthetic sound by performing a mouse operation, a touch operation, or the like, thereby specifying the voice quality. In the example illustrated in FIG. 6, the user selects the check box 235 of "cute". In this case, the user's operation of selecting the check box 235 of "cute" corresponds to the first operation.

The first operation performed on the first area 231 is received by the first operation receiving unit 112, and the upper level expression score vector corresponding to the first operation is generated. In a case where the first area 231 employs the option format illustrated in FIG. 6, for example, the upper level expression score vector is generated in which only the dimension of the upper level expression UE selected by the user on the first area 231 has a higher value (e.g., 1), and the dimension of the others has an average value (e.g., 0). The values of the dimensions of the upper level expression score vector are not limited thereto because they depend on the range of the scores of the upper level expressions UE. The score transforming unit 120 transforms the upper level expression score vector corresponding to the first operation into the lower level expression score vector.

The second area 232 is an area that exhibits, to the user, the lower level expression score vector resulting from transformation performed by the score transforming unit 120 and on which the user performs the second operation. While various formats that exhibit the lower level expression score vector to the user and cause the user to perform the second operation are known, FIG. 6 illustrates the second area 232 of a format that visualizes the lower level expression score vector with slider bars indicating respective lower level expressions LE assumed in the present embodiment, for example. In the second area 232 illustrated in FIG. 6, the position of a knob 236 of a slider bar indicates the score of the lower level expression LE corresponding to the slider bar (value of the dimension of the lower level expression score vector). In other words, the positions of the knobs 236 of the slider bars corresponding to the respective lower level expressions LE are preset based on the values of the dimensions of the lower level expression score vector resulting from transformation of the upper level expression score vector corresponding to the first operation. The user moves the knob 236 of the slider bar corresponding to a certain lower level expression LE, thereby changing the value of the lower level expression score vector resulting from transformation. In this case, the user's operation of moving the knob 236 of the slider bar corresponding to the certain lower level expression LE corresponds to the second operation.

The second operation performed on the second area 232 is received by the second operation receiving unit 113. The value of the lower level expression score vector resulting from transformation performed by the score transforming unit 120 is changed based on the second operation. The voice synthesizing unit 130 generates the synthetic sound S having voice quality corresponding to the lower level expression score vector changed based on the second operation.

The reproduction button 233 is operated by the user to listen to the synthetic sound S generated by the voice synthesizing unit 130. The user inputs the certain text T to the text box 230, performs the first operation on the first area 231, and operates the reproduction button 233. With this operation, the user causes the speaker to output the synthetic sound S of the text T based on the lower level expression score vector resulting from transformation of the upper level expression score vector corresponding to the first operation, thereby listening to the synthetic sound S. If the voice quality of the synthetic sound S is different from a desired voice quality, the user performs the second operation on the second area 232 and operates the reproduction button 233 again. With this operation, the user causes the speaker to output the synthetic sound S based on the lower level expression score vector changed based on the second operation, thereby listening to the synthetic sound S. The user can obtain the synthetic sound S having the desired voice quality by a simple operation of repeating the operations described above until the synthetic sound S having the desired voice quality is obtained.

The save button 234 is operated by the user to save the synthetic sound S having the desired voice quality obtained by the operations described above. Specifically, if the user performs the operations described above and operates the save button 234, the finally obtained synthetic sound S having the desired voice quality is saved. Instead of saving the synthetic sound S having the desired voice quality, the voice synthesizing device 100 may save the lower level expression score vector used to generate the synthetic sound S having the desired voice quality.

Figure 7:
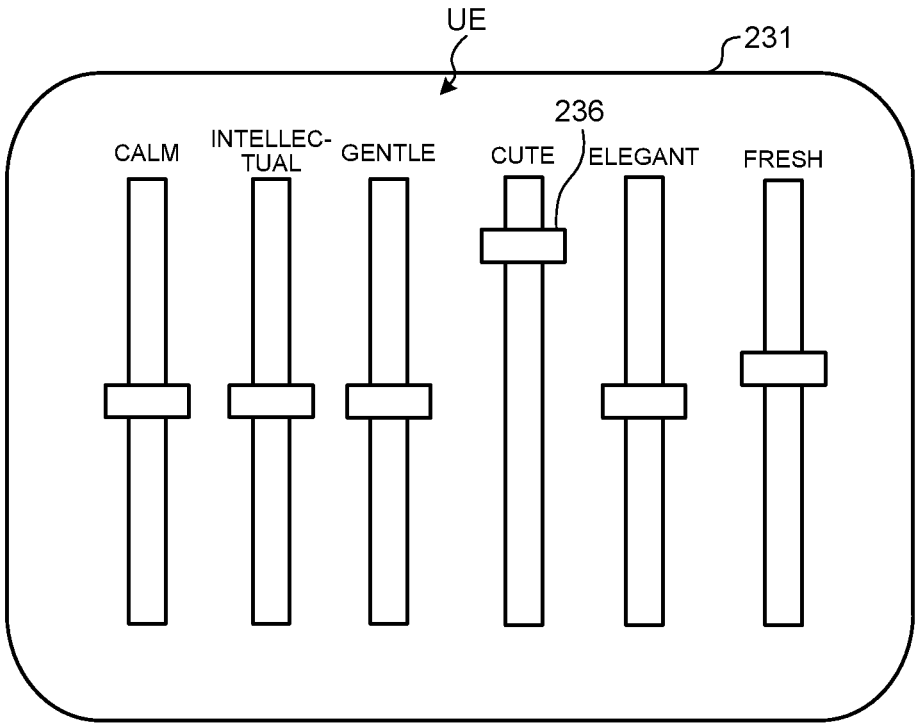
FIG. 7 is a schematic illustrating a first area of a slider bar format.

While FIG. 6 illustrates the first area 231 of an option format as the first area 231 in the edit screen ES, the first area 231 simply needs to be a format that receives the first operation and is not limited to the option format. As illustrated in FIG. 7, for example, the first area 231 may be a slider bar format similar to that of the second area 232 illustrated in FIG. 6. In a case where the first area 231 is a slider bar format, the user can specify a desired voice quality based on a plurality of upper level expressions UE. In this case, the user's operation of moving the knob 236 of the slider bar corresponding to a certain upper level expression UE corresponds to the first operation. A vector adopting the positions of the knobs 236 of the slider bars corresponding to the respective upper level expressions UE as its values without any change, for example, is generated as the upper level expression score vector.

Figure 8:
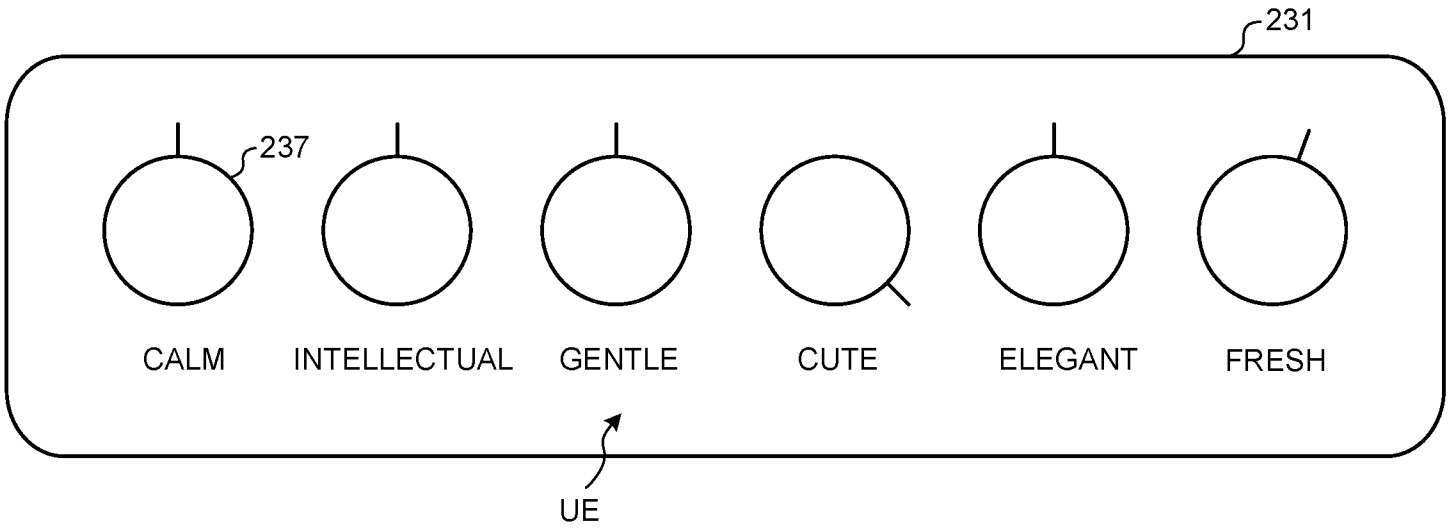
FIG. 8 is a schematic illustrating the first area of a dial format.

Alternatively, as illustrated in FIG. 8, for example, the first area 231 may be a dial format including rotatable dials 237 corresponding to the respective upper level expressions UE. In a case where the first area 231 is a dial format, the user can specify a desired voice quality based on a plurality of upper level expressions UE similarly to the first area 231 of a slider bar format. In this case, the user's operation of moving the dial 237 corresponding to a certain upper level expression UE corresponds to the first operation. A vector adopting the positions of the dials 237 corresponding to the respective upper level expressions UE as its values without any change, for example, is generated as the upper level expression score vector.

Figure 9:
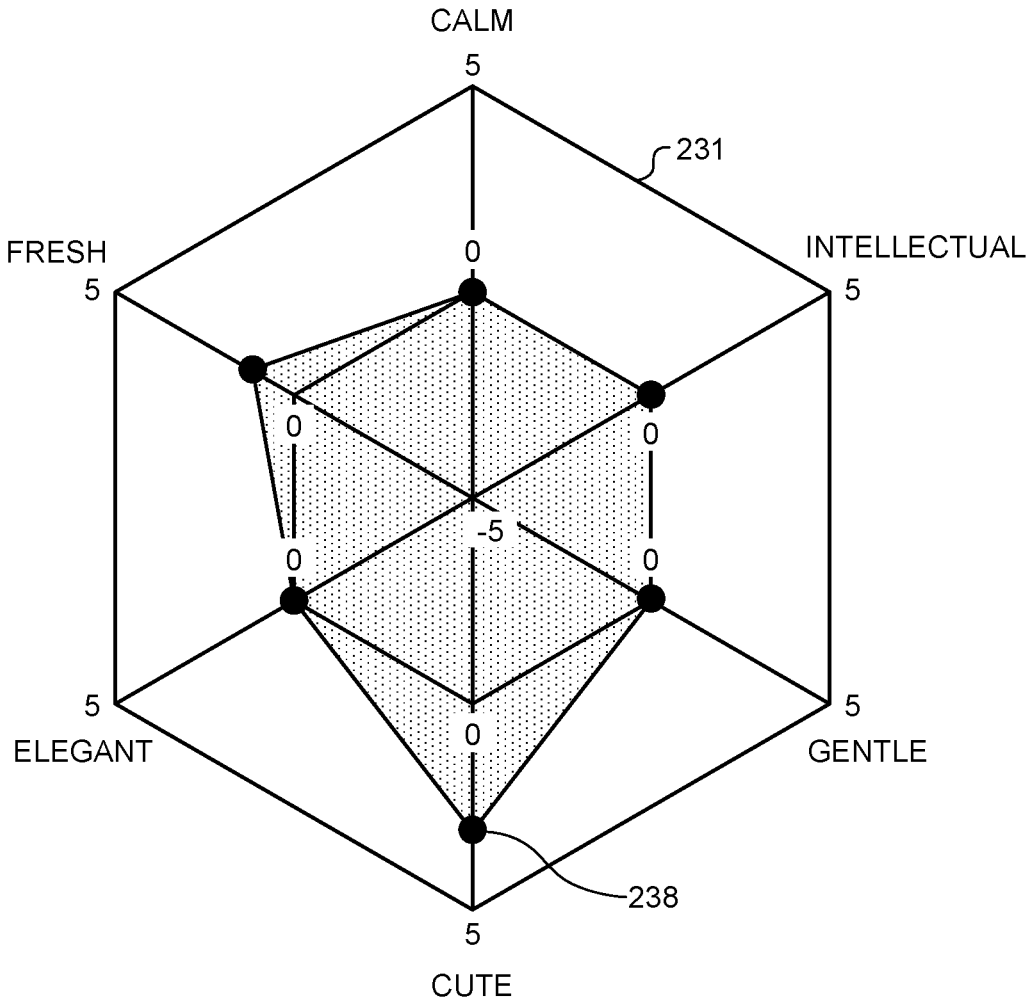
FIG. 9 is a schematic illustrating the first area of a radar chart format.

Alternatively, as illustrated in FIG. 9, for example, the first area 231 may be a radar chart format having the upper level expressions UE as its respective axes. In a case where the first area 231 is a radar chart format, the user can specify a desired voice quality based on a plurality of upper level expressions UE similarly to the first area 231 of a slider bar format and a dial format. In this case, the user's operation of moving a pointer 238 on an axis corresponding to a certain upper level expression UE corresponds to the first operation. A vector adopting the positions of the pointers 238 on the axes corresponding to the respective upper level expressions UE as its values without any change, for example, is generated as the upper level expression score vector.

Figure 10:
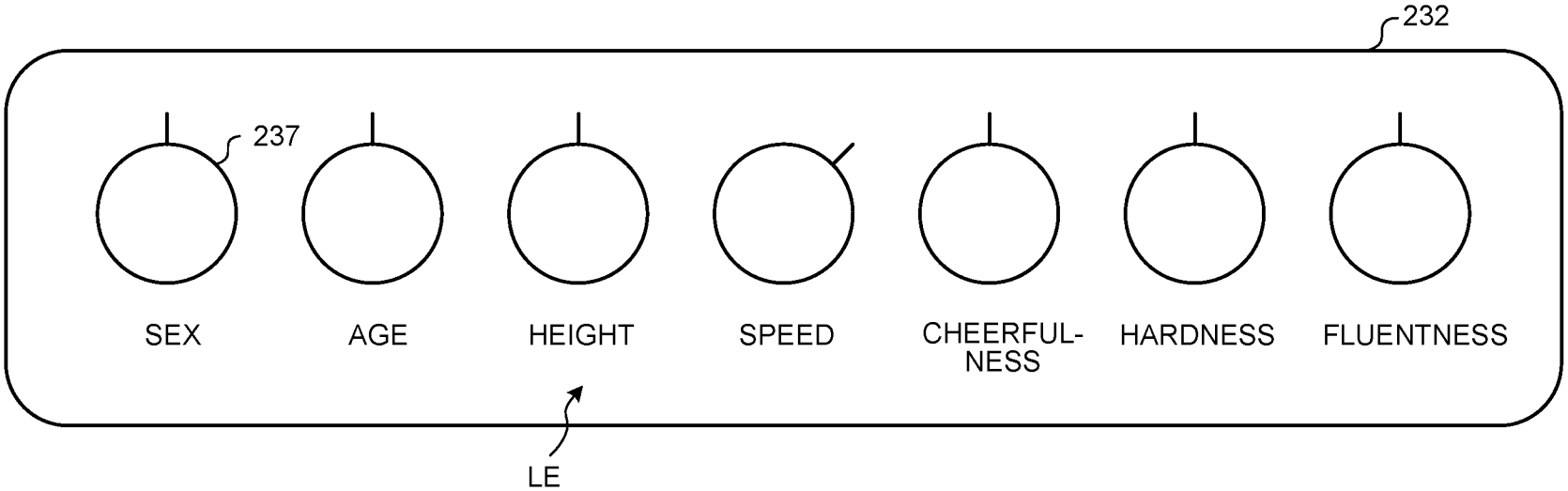
FIG. 10 is a schematic illustrating a second area of a dial format.

While FIG. 6 illustrates the second area 232 of a slider bar format as the second area 232 in the edit screen ES, the second area 232 simply needs to be a format that can receive the second operation while exhibiting the lower level expression score vector to the user and is not limited to the slider bar format. As illustrated in FIG. 10, for example, the second area 232 may be a dial format similar to that of the first area 231 illustrated in FIG. 8. In a case where the second area 232 is a dial format, the positions of the dials 237 corresponding to the respective lower level expressions LE are preset based on the values of the dimensions of the lower level expression score vector resulting from transformation of the upper level expression score vector corresponding to the first operation. The user moves the dial 237 corresponding to a certain lower level expression LE, thereby changing the value of the lower level expression score vector resulting from transformation. In this case, the user's operation of moving the dial 237 corresponding to the certain lower level expression LE corresponds to the second operation.

Figure 11:
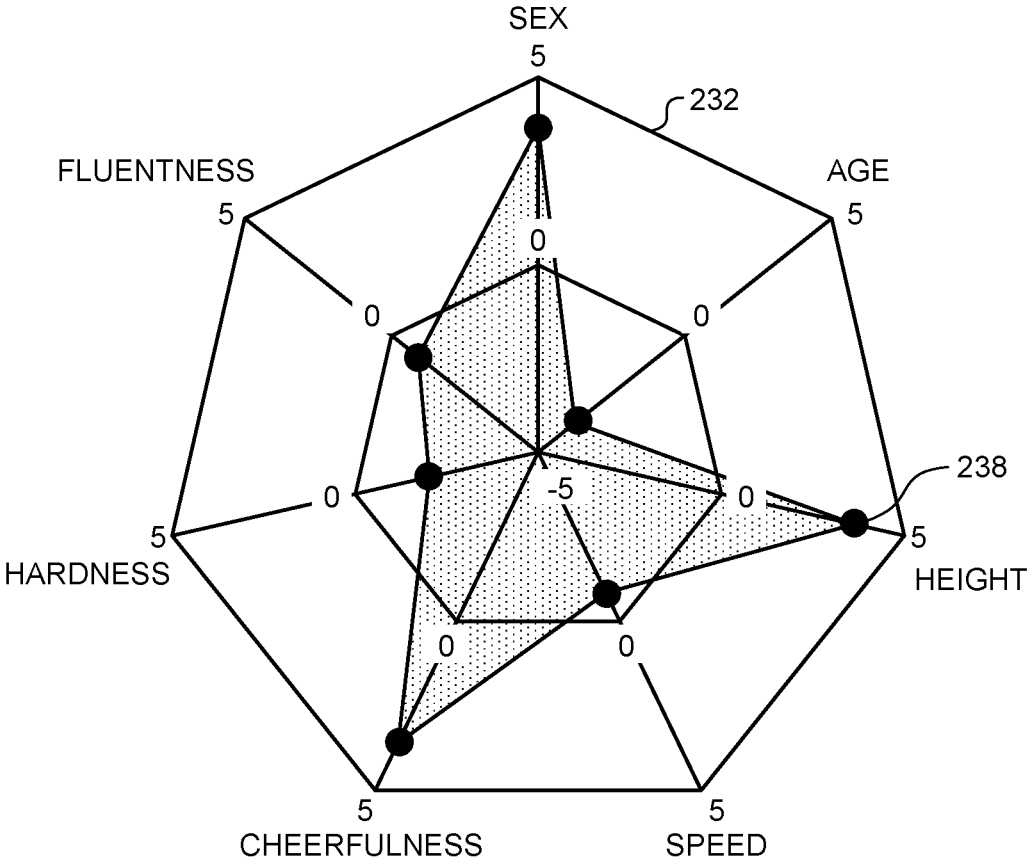
FIG. 11 is a schematic illustrating the second area of a radar chart format.

Alternatively, as illustrated in FIG. 11, for example, the second area 232 may be a radar chart format similar to that of the first area 231 illustrated in FIG. 9. In a case where the second area 232 is a radar chart format, the positions of the pointers 238 on the axes corresponding to the respective lower level expressions LE are preset based on the values of the dimensions of the lower level expression score vector resulting from transformation of the upper level expression score vector corresponding to the first operation. The user moves the pointer 238 on the axes corresponding to a certain lower level expression LE, thereby changing the value of the lower level expression score vector resulting from transformation. In this case, the user's operation of moving the pointer 238 corresponding to the certain lower level expression LE on the axes corresponds to the second operation.

Figure 12:
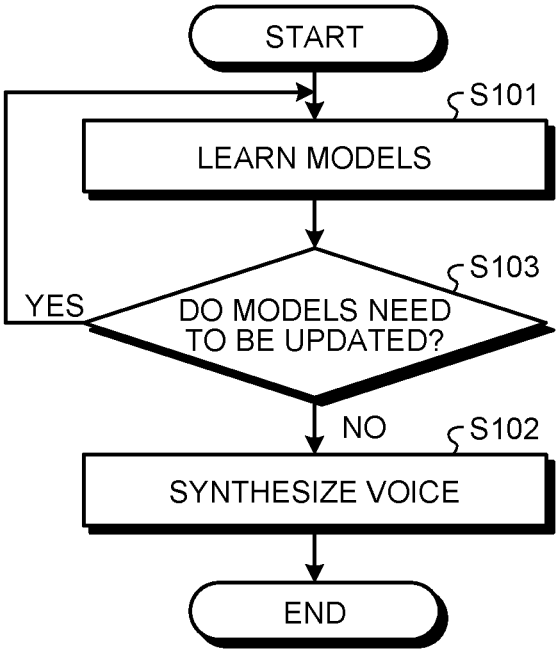
FIG. 12 is a flowchart illustrating an outline of an operation performed by the voice synthesizing device.
Figure 13:
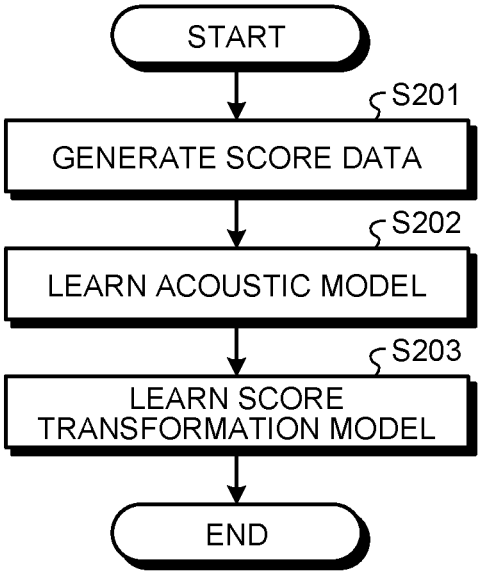
FIG. 13 is a flowchart illustrating a procedure of learning of models.
Figure 14:
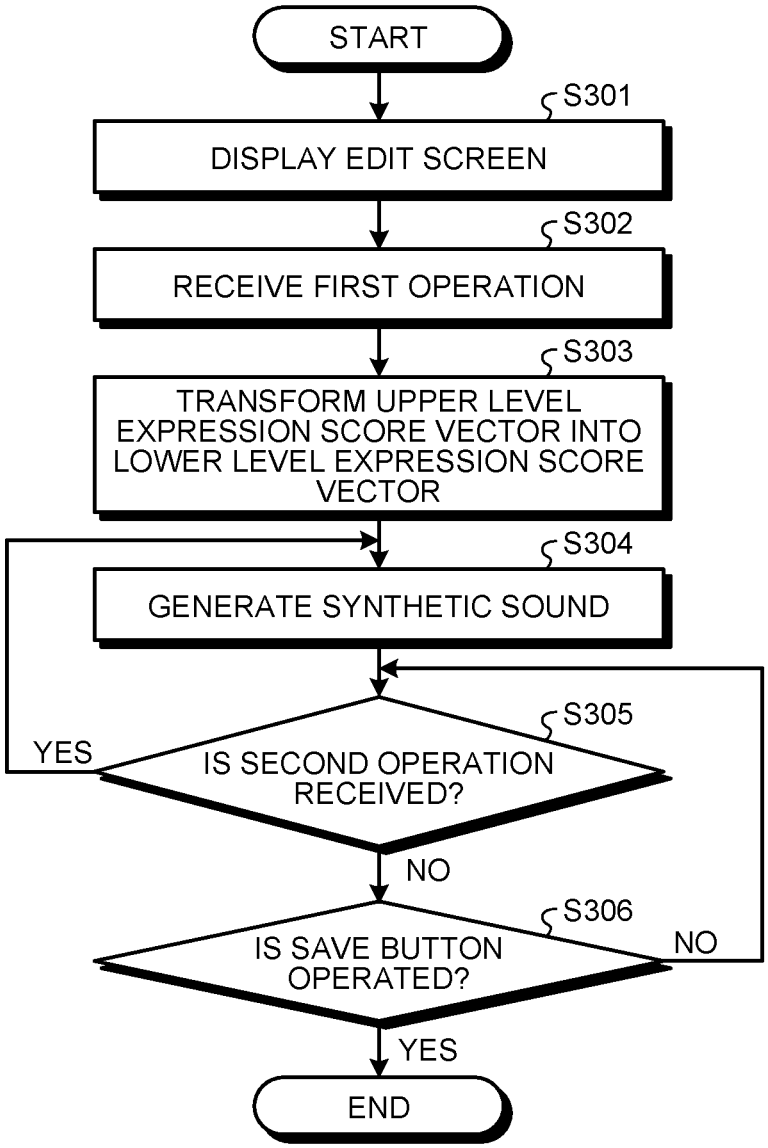
FIG. 14 is a flowchart illustrating a procedure of a voice synthesis.

The following describes operations performed by the voice synthesizing device 100 according to the present embodiment with reference to the flowcharts illustrated in FIGS. 12 to 14.

FIG. 12 is a flowchart illustrating an outline of an operation performed by the voice synthesizing device 100 according to the present embodiment. As illustrated in FIG. 12, the operation performed by the voice synthesizing device 100 according to the present embodiment is divided into two steps of Step S101 for learning models and Step S102 for synthesizing a voice. The learning of models at Step S101 is basically performed once at the first time. If it is determined that the models need to be updated (Yes at Step S103) when a voice is added to the speaker database 101, for example, the learning of models at Step S101 is performed again. If the models need not be updated (No at Step S103), a voice is synthesized at Step S102 using the models.

FIG. 13 is a flowchart illustrating a procedure of learning of models at Step S101 in FIG. 12. In the learning of models, the voice quality evaluating unit 103 generates the score data of the upper level expressions UE and the score data of the lower level expressions LE of all the speakers stored in the speaker database 101. The voice quality evaluating unit 103 then stores the score data of the upper level expressions UE in the upper level expression score storage unit 104 and stores the score data of the lower level expressions LE in the lower level expression score storage unit 105 (Step S201).

The acoustic model learning unit 106 learns an acoustic model based on the acoustic features and the context labels retained in the speaker database 101 and on the score data of the lower level expressions LE retained in the lower level expression score storage unit 105 and stores the acoustic model obtained by the learning in the acoustic model storage unit 107 (Step S202). The score transformation model learning unit 108 learns a score transformation model based on the score data of the upper level expressions UE retained in the upper level expression score storage unit 104 and on the score data of the lower level expressions LE retained in the lower level expression score storage unit 105 and stores the score transformation model obtained by the learning in the score transformation model storage unit 109 (Step S203). The learning of the acoustic model at Step S202 and the learning of the score transformation model at Step S203 may be performed in parallel.

FIG. 14 is a flowchart illustrating a procedure of a voice synthesis at Step S102 in FIG. 12. In the voice synthesis, the display control unit 111 of the editing supporting unit 110 performs control for causing the display device to display the edit screen ES (Step S301). The first operation receiving unit 112 receives the first operation performed by the user on the first area 231 on the edit screen ES and generates the upper level expression score vector corresponding to the first operation (Step S302).

Subsequently, the score transforming unit 120 transforms the upper level expression score vector generated at Step S302 into the lower level expression score vector based on the score transformation model retained in the score transformation model storage unit 109 (Step S303). The voice synthesizing unit 130 uses the acoustic model retained in the acoustic model storage unit 107 to generate the synthetic sound S having voice quality corresponding to the lower level expression score vector resulting from transformation of the upper level expression score vector at Step S303 as the synthetic sound S corresponding to the input certain text T (Step S304). The synthetic sound S is reproduced by the user operating the reproduction button 233 on the edit screen ES and is output from the speaker.

At this time, the second area 232 on the edit screen ES exhibits, to the user, the lower level expression score vector corresponding to the reproduced synthetic sound S such that the user can visually grasp it. If the user performs the second operation on the second area 232, and the second operation is received by the second operation receiving unit 113 (Yes at Step S305), the lower level expression score vector is changed based on the second operation. In this case, the process is returned to Step S304, and the voice synthesizing unit 130 generates the synthetic sound S having the voice quality corresponding to the lower level expression score vector. This processing is repeated every time the second operation receiving unit 113 receives the second operation.

By contrast, if the user does not perform the second operation on the second area 232 (No at Step S305) but operates the save button 234 (Yes at Step S306), the synthetic sound generated at Step S304 is saved, and the voice synthesis is finished. If the save button 234 is not operated (No at Step S306), the second operation receiving unit 113 continuously waits for input of the second operation.

If the user performs the first operation again on the first area 231 before operating the save button 234, that is, if the user performs an operation to change specification of the voice quality using the upper level expressions UE, which is not illustrated in FIG. 14, the process is returned to Step S302. At Step S302, the first operation receiving unit 112 receives the first operation again, and the subsequent processing is repeated. As described above, the voice synthesizing device 100 according to the present embodiment combines voice quality editing using the upper level expressions UE and voice quality editing using the lower level expressions LE. Consequently, the voice synthesizing device 100 can appropriately generate a synthetic sound having various types of voice qualities desired by the user with a simple operation.

As described above in detail with reference to a specific example, if the user performs the first operation to specify a desired voice quality based on one or more upper level expressions UE, the voice synthesizing device 100 according to the present embodiment transforms the upper level expression score vector corresponding to the first operation into the lower level expression score vector. Subsequently, the voice synthesizing device 100 generates a synthetic sound having the voice quality corresponding to the lower level expression score vector. The voice synthesizing device 100 exhibits, to the user, the lower level expression score vector resulting from transformation of the upper level expression score vector such that the user can visually grasp it. If the user performs the second operation to change the lower level expression score vector, the voice synthesizing device 100 generates a synthetic sound having the voice quality corresponding to the lower level expression score vector changed based on the second operation. Consequently, the user can obtain a synthetic sound having the desired voice quality by specifying an abstract and rough voice quality (e.g., a calm voice, a cute voice, and an elegant voice) and then fine-tuning the characteristics of a less abstract voice quality, such as the sex, the age, the height, and the cheerfulness. The voice synthesizing device 100 thus enables the user to appropriately generate the synthetic sound having the desired voice quality with a simple operation.

Second Embodiment

A second embodiment is described below. The voice synthesizing device 100 according to the present embodiment is obtained by adding a function to assist voice quality editing to the voice synthesizing device 100 according to the first embodiment. Components common to those of the first embodiment are denoted by common reference numerals, and overlapping explanation thereof is appropriately omitted. The following describes characteristic parts of the second embodiment.

Figure 15:
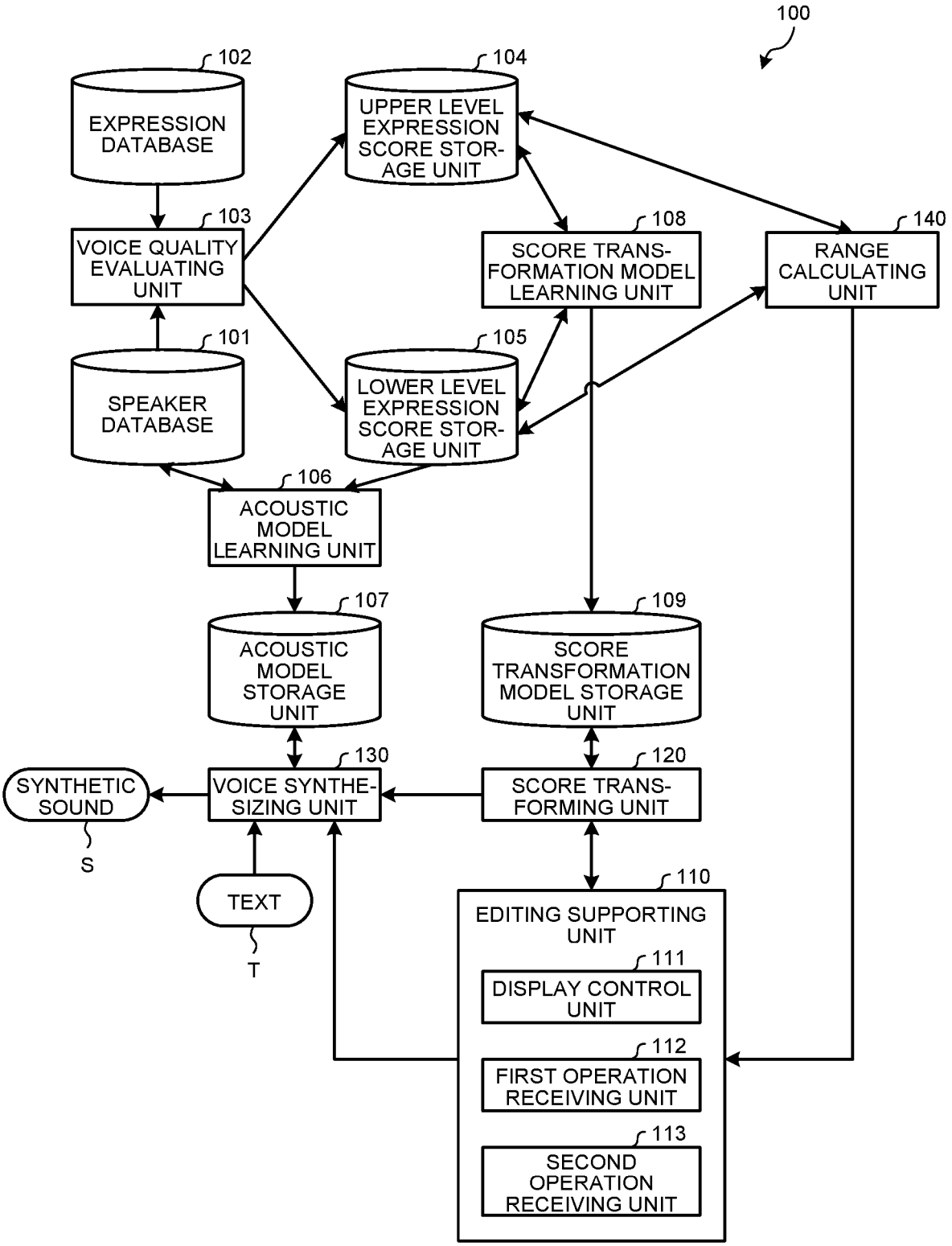
FIG. 15 is a block diagram illustrating an exemplary functional configuration of the voice synthesizing device according to a second embodiment.

FIG. 15 is a block diagram illustrating an exemplary functional configuration of the voice synthesizing device 100 according to the second embodiment. As illustrated in FIG. 15, the voice synthesizing device 100 according to the present embodiment has a configuration obtained by adding a range calculating unit 140 to the voice synthesizing device 100 according to the first embodiment (see FIG. 1).

The range calculating unit 140 calculates a range of the scores of the lower level expressions LE that can maintain the characteristics of the voice quality specified by the first operation (hereinafter, referred to as a "controllable range") based on the score data of the upper level expressions UE retained in the upper level expression score storage unit 104 and on the score data of the lower level expressions LE retained in the lower level expression score storage unit 105. The controllable range calculated by the range calculating unit 140 is transmitted to the editing supporting unit 110 and reflected on the edit screen ES displayed on the display device by the display control unit 111. In other words, the display control unit 111 causes the display device to display the edit screen ES including the second area 232 that exhibits, to the user, the lower level expression score vector resulting from transformation performed by the score transforming unit 120 together with the controllable range calculated by the range calculating unit 140.

Figure 16:
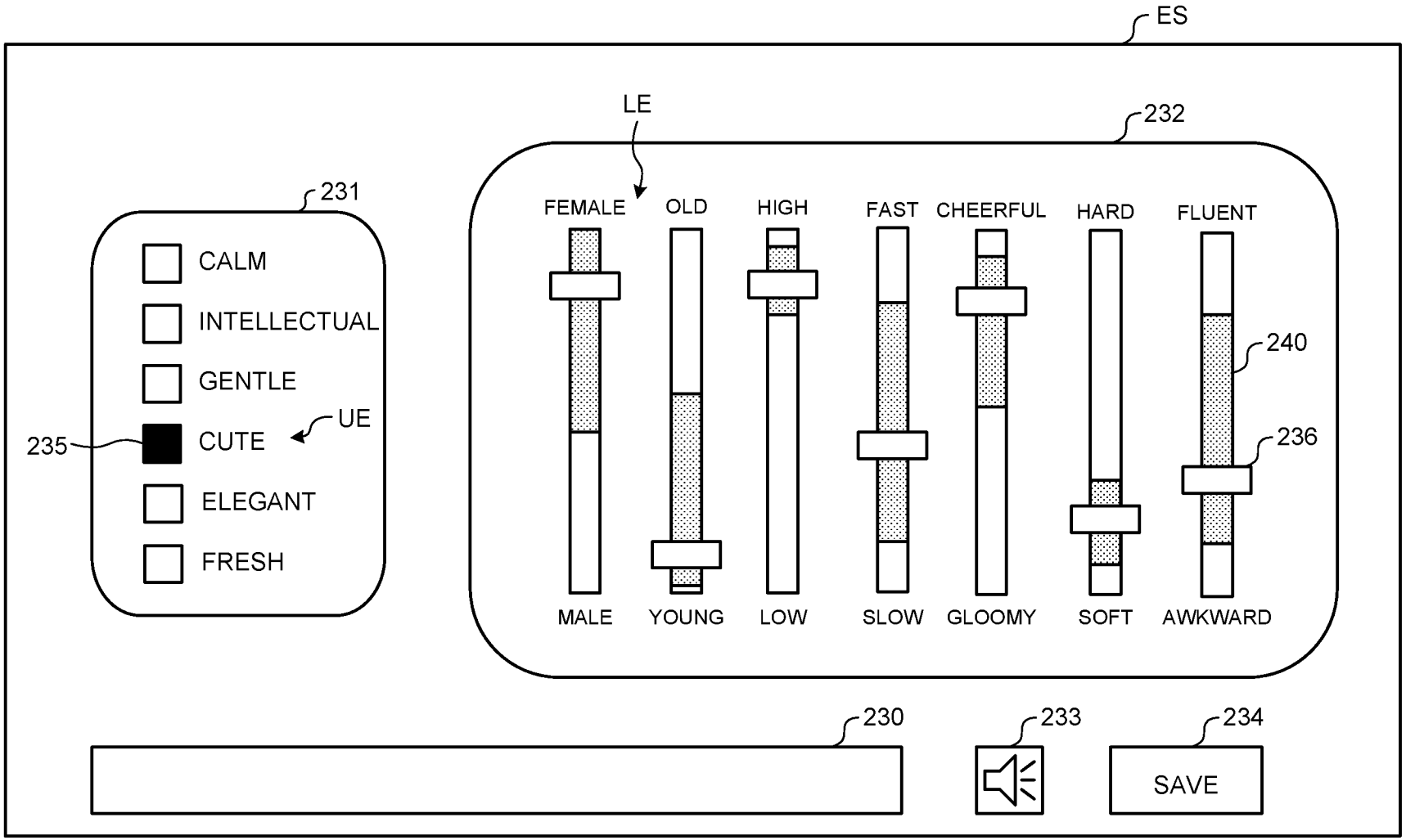
FIG. 16 is a schematic illustrating an example of the edit screen.

FIG. 16 is a schematic illustrating an example of the edit screen ES according to the present embodiment. On the edit screen ES illustrated in FIG. 16, the first operation to select the check box 235 of "cute" is performed on the first area 231 similarly to the edit screen ES illustrated in FIG. 6. The edit screen ES in FIG. 16 is different from the edit screen ES in FIG. 6 as follows: the controllable range that can maintain the characteristics of the voice quality ("cute" in this example) specified by the first operation is exhibited in the second area 232 by strip-shaped marks 240 such that the user can visually grasp it. The user moves the knobs 236 of the slider bars within the range of the strip-shaped marks 240, thereby obtaining a synthetic sound of various types of cute voices.

Figure 17:
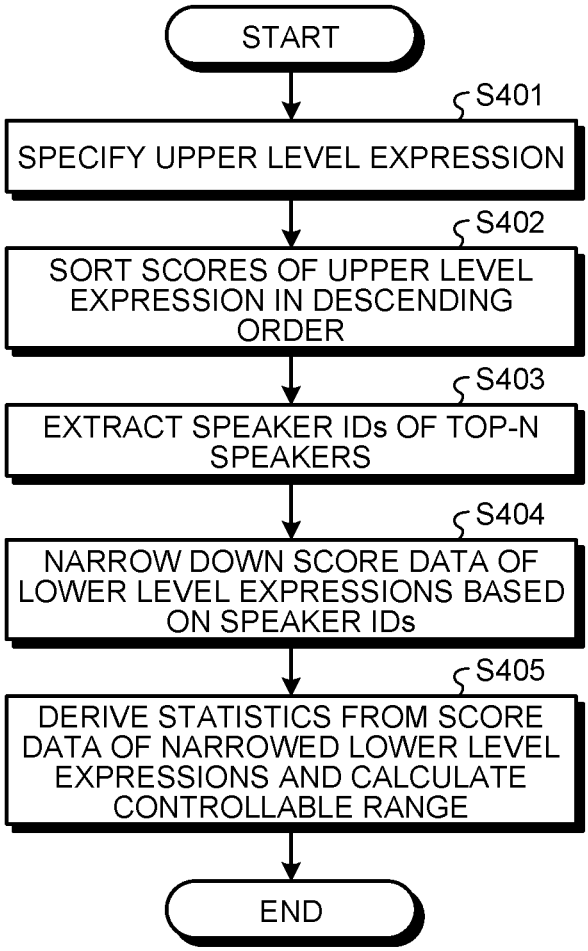
FIG. 17 is a flowchart illustrating an example of a procedure performed by a range calculating unit.

FIG. 17 is a flowchart illustrating an example of a procedure performed by the range calculating unit 140 according to the present embodiment. The range calculating unit 140 specifies the upper level expression UE ("cute" in the example illustrated in FIG. 16) corresponding to the first operation (Step S401). Subsequently, the range calculating unit 140 sorts the scores in the column corresponding to the upper level expression UE specified at Step S401 in descending order out of the score data of the upper level expressions UE retained in the upper level expression score storage unit 104 (Step S402). The range calculating unit 140 extracts the speaker IDs of the top-N speakers in descending order of the scores of the upper level expressions UE sorted at Step S402 (Step S403).

Subsequently, the range calculating unit 140 narrows down the score data of the lower level expressions LE retained in the lower level expression score storage unit 105 based on the speaker IDs of the top-N speakers extracted at Step S403 (Step S404). Finally, the range calculating unit 140 derives the statistics of the respective lower level expressions LE from the score data of the lower level expressions LE narrowed down at Step S404 and calculates the controllable range using the statistics (Step S405). Examples of the statistic indicating the center of the controllable range include, but are not limited to, the average, the median, the mode, etc. Examples of the statistic indicating the boundary of the controllable range include, but are not limited to, the minimum value, the maximum value, the standard deviation, the quartile, etc.

Figure 18:
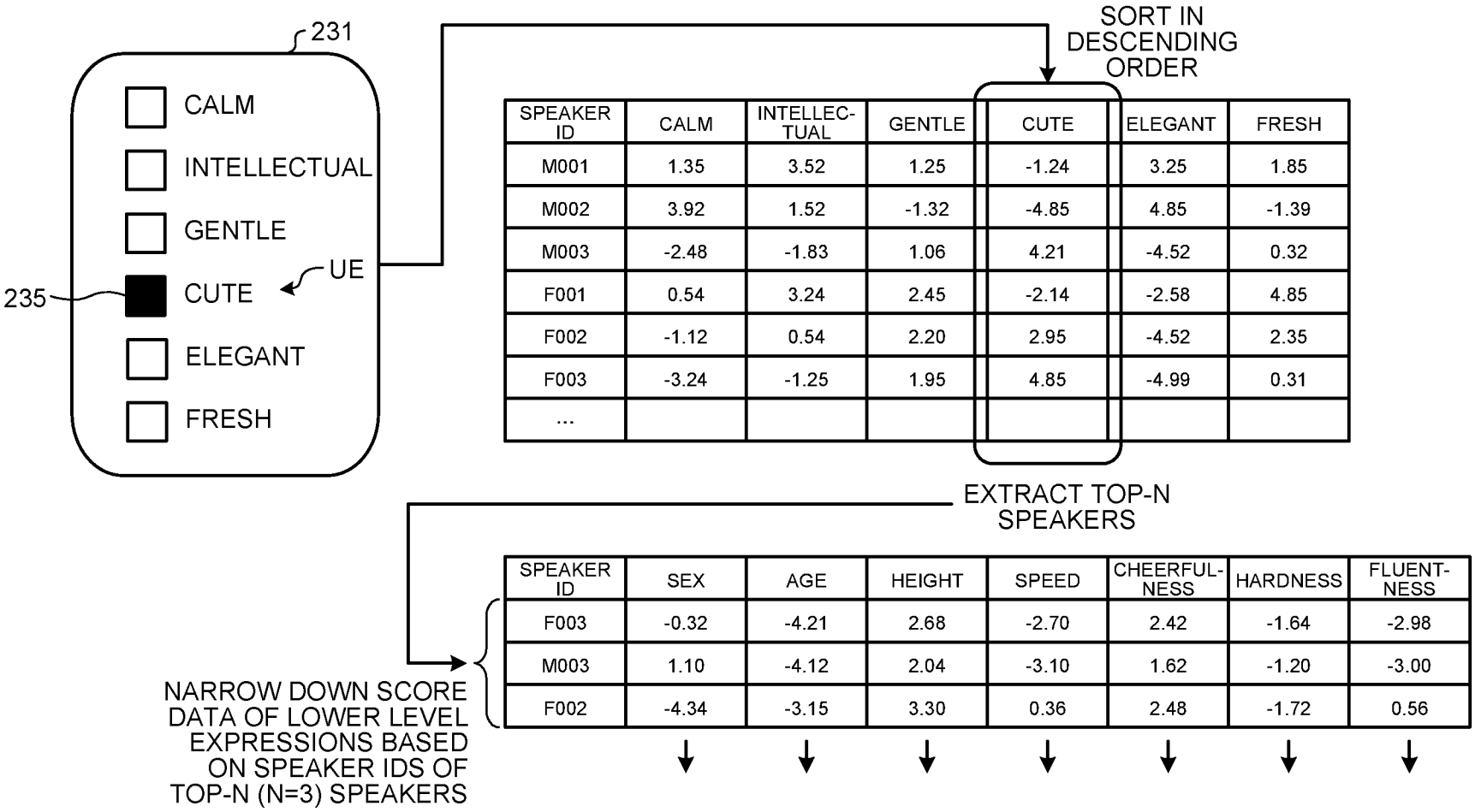
FIG. 18 is a schematic illustrating a specific example of the procedure.

FIG. 18 is a schematic illustrating a specific example of the procedure described above. FIG. 18 illustrates an example where the first operation to select the check box 235 of "cute" is performed on the first area 231. If "cute" is specified as the upper level expression UE corresponding to the voice quality specified by the first operation, the scores in the column corresponding to "cute" are sorted in descending order out of the score data of the upper level expressions UE. Subsequently, the speakers ID of the top-N (three in this example) speakers are extracted. The score data of the lower level expressions LE is narrowed down based on the extracted speaker IDs. The statistics of the respective lower level expressions LE are calculated from the score data of the narrowed lower level expressions LE.

As described above, the first operation is assumed to be performed on the first area 231 of an option format illustrated in FIG. 16. The range calculating unit 140, however, can calculate the controllable range in the same manner as that of the example above in a case where the first operation to specify the voice quality is performed based on a plurality of upper level expressions UE using the first area 231 of a slider bar format illustrated in FIG. 7, a dial format illustrated in FIG. 8, a radar chart format illustrated in FIG. 9, and other format. In this case, the range calculating unit 140 acquires the upper level expression score vector corresponding to the first operation instead of specifying the upper level expression UE corresponding to the first operation at Step S401 in FIG. 17. Furthermore, the range calculating unit 140 extracts the speaker IDs of the top-N speakers in ascending order of distance (e.g., a Euclidian distance) from the acquired upper level expression score vector instead of sorting the scores in descending order at Step S402 and extracting the speaker IDs of the top-N speakers at Step S403.

In exhibition of the controllable range calculated by the range calculating unit 140 on the second area 232 on the edit screen ES illustrated in FIG. 16, for example, an operation performed on one axis does not affect another axis if the axes of the respective lower level expressions LE are completely independent of one another. It is difficult, however, for the axes to be completely independent of one another in an actual configuration. The axis of the sex, for example, is assumed to highly correlate with the axis of the height. This is because a voice tends to become higher as the sex is closer to a woman and tends to become lower as the sex is closer to a man. In view of the relation between the axes, the strip-shaped marks 240 indicating the controllable range may dynamically expand and contract.

Figure 19:
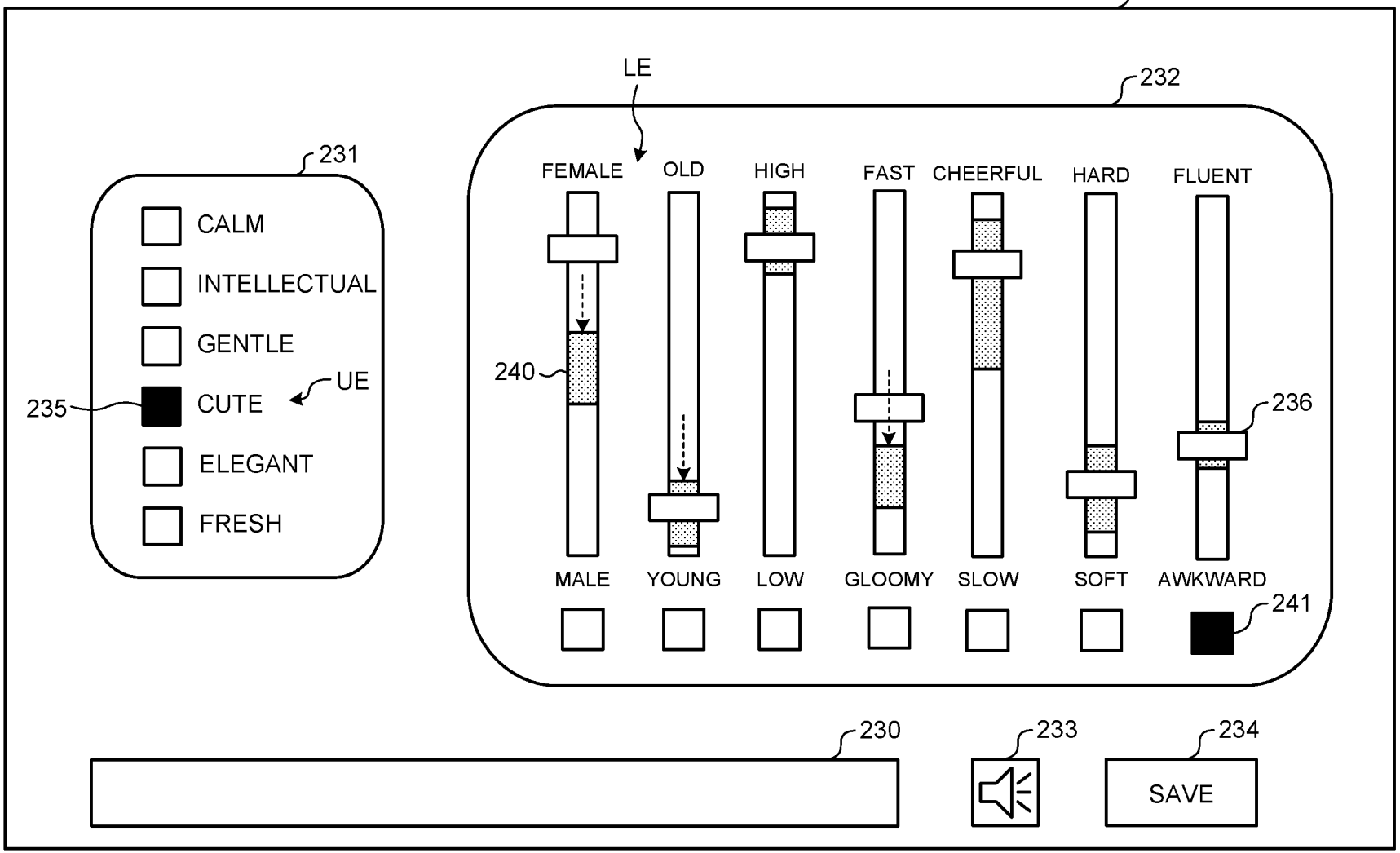
FIG. 19 is a schematic illustrating another example of the edit screen.

FIG. 19 is a schematic illustrating another example of the edit screen ES. In the example, the second area 232 includes check boxes 241 used to fix the positions of the knobs 236 of the slider bars corresponding to the respective lower level expressions LE. In the example illustrated in FIG. 19, the first operation to select the check box 235 of "cute" is performed on the first area 231, and the position of the knob 236 of the slider bar corresponding to the fluentness is fixed by operating the check box 241. Fixing the position of the knob 236 of the slider bar corresponding to the fluentness causes the strip-shaped marks 240 indicating the controllable range of the sex, the age, and the speed, which relate to the fluentness, to dynamically change.

To implement such a system, the range calculating unit 140 may narrow down the score data of the lower level expressions LE at Step S404 in FIG. 17, further narrow down the score data based on the speakers having the fixed value of the lower level expression LE, and calculate the statistics again. It is necessary to allow certain latitude because few speakers have a value completely equal to the fixed value of the lower level expression LE. The range calculating unit 140 may narrow down the speakers based on data in a range of −1 to +1 for the fixed value of the lower level expression LE, for example.

As described above, the voice synthesizing device 100 according to the present embodiment exhibits, to the user, the controllable range that can maintain the characteristics of the voice quality specified by the first operation. The voice synthesizing device 100 thus enables the user to generate various types of voice qualities more intuitively.

While the present embodiment describes a method for calculating the controllable range based on the score data of the upper level expressions UE and the score data of the lower level expressions LE, for example, the method for calculating the controllable range is not limited thereto. The present embodiment may employ a method of using a statistical model learned from data, for example. While the present embodiment represents the controllable range with the strip-shaped marks 240, the way of representation is not limited thereto. Any way of representation may be employed as long as it can exhibit the controllable range to the user such that he/she can visually grasp the controllable range.

Third Embodiment

A third embodiment is described below. The voice synthesizing device 100 according to the present embodiment is obtained by adding a function to assist voice quality editing by a method different from that of the second embodiment to the voice synthesizing device 100 according to the first embodiment as described above. Components common to those of the first embodiment are denoted by common reference numerals, and overlapping explanation thereof is appropriately omitted. The following describes characteristic parts of the third embodiment.

Figure 20:
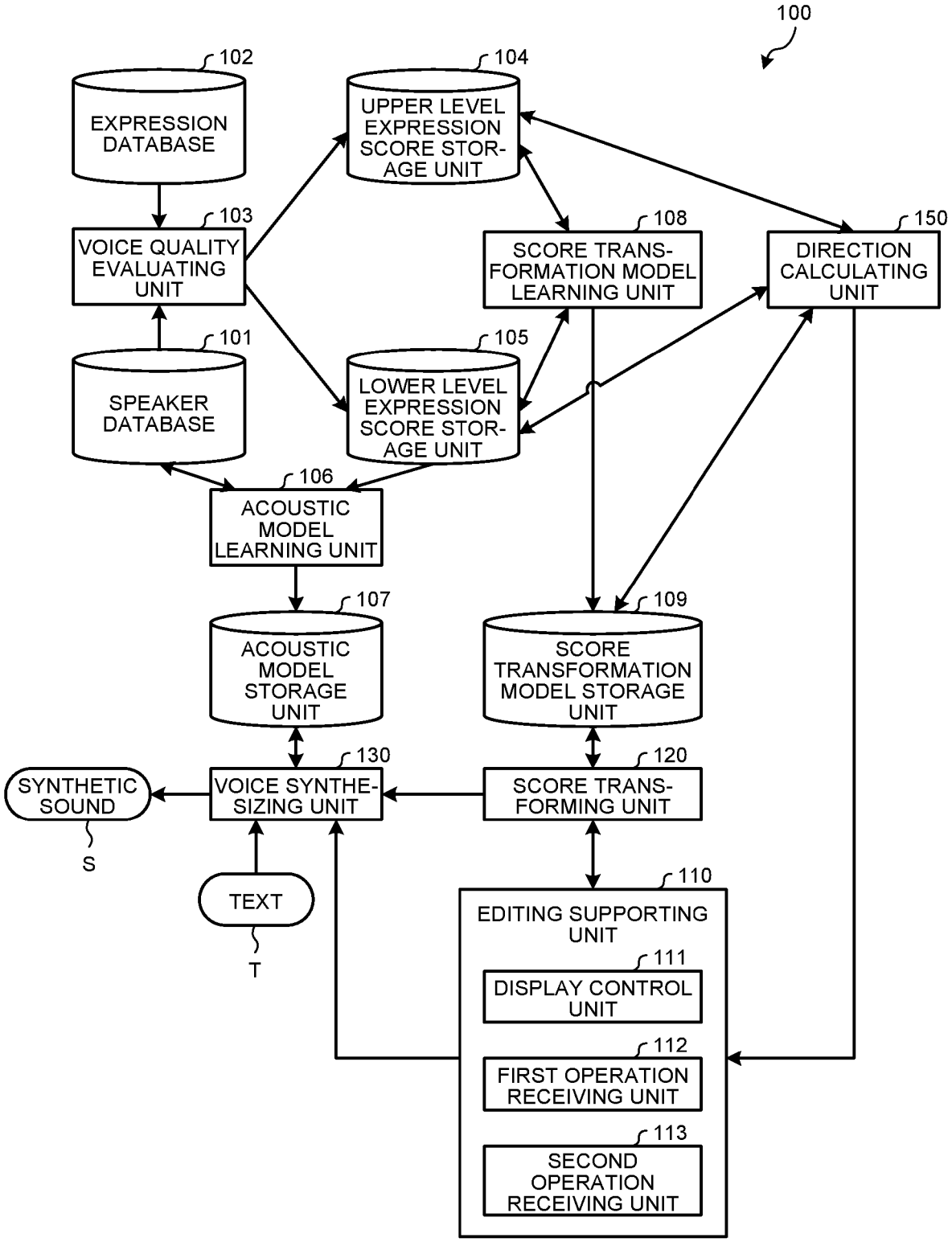
FIG. 20 is a block diagram illustrating an exemplary functional configuration of the voice synthesizing device according to a third embodiment.

FIG. 20 is a block diagram illustrating an exemplary functional configuration of the voice synthesizing device 100 according to the third embodiment. As illustrated in FIG. 20, the voice synthesizing device 100 according to the present embodiment has a configuration obtained by adding a direction calculating unit 150 to the voice synthesizing device 100 according to the first embodiment (see FIG. 1).

The direction calculating unit 150 calculates the direction of changing the scores of the lower level expressions LE so as to enhance the characteristics of the voice quality specified by the first operation (hereinafter, referred to as a "control direction") and the degree of enhancement of the characteristics of the voice quality specified by the first operation when the scores are changed in the control direction (hereinafter, referred to as a "control magnitude"). The direction calculating unit 150 calculates the control direction and the control magnitude based on the score data of the upper level expressions UE retained in the upper level expression score storage unit 104, on the score data of the lower level expressions LE retained in the lower level expression score storage unit 105, and on the score transformation model retained in the score transformation model storage unit 109. The control direction and the control magnitude calculated by the direction calculating unit 150 are transmitted to the editing supporting unit 110 and reflected on the edit screen ES displayed on the display device by the display control unit 111. In other words, the display control unit 111 causes the display device to display the edit screen ES including the second area 232 that exhibits, to the user, the lower level expression score vector resulting from transformation performed by the score transforming unit 120 together with the control direction and the control magnitude calculated by the direction calculating unit 150.

Figure 21:
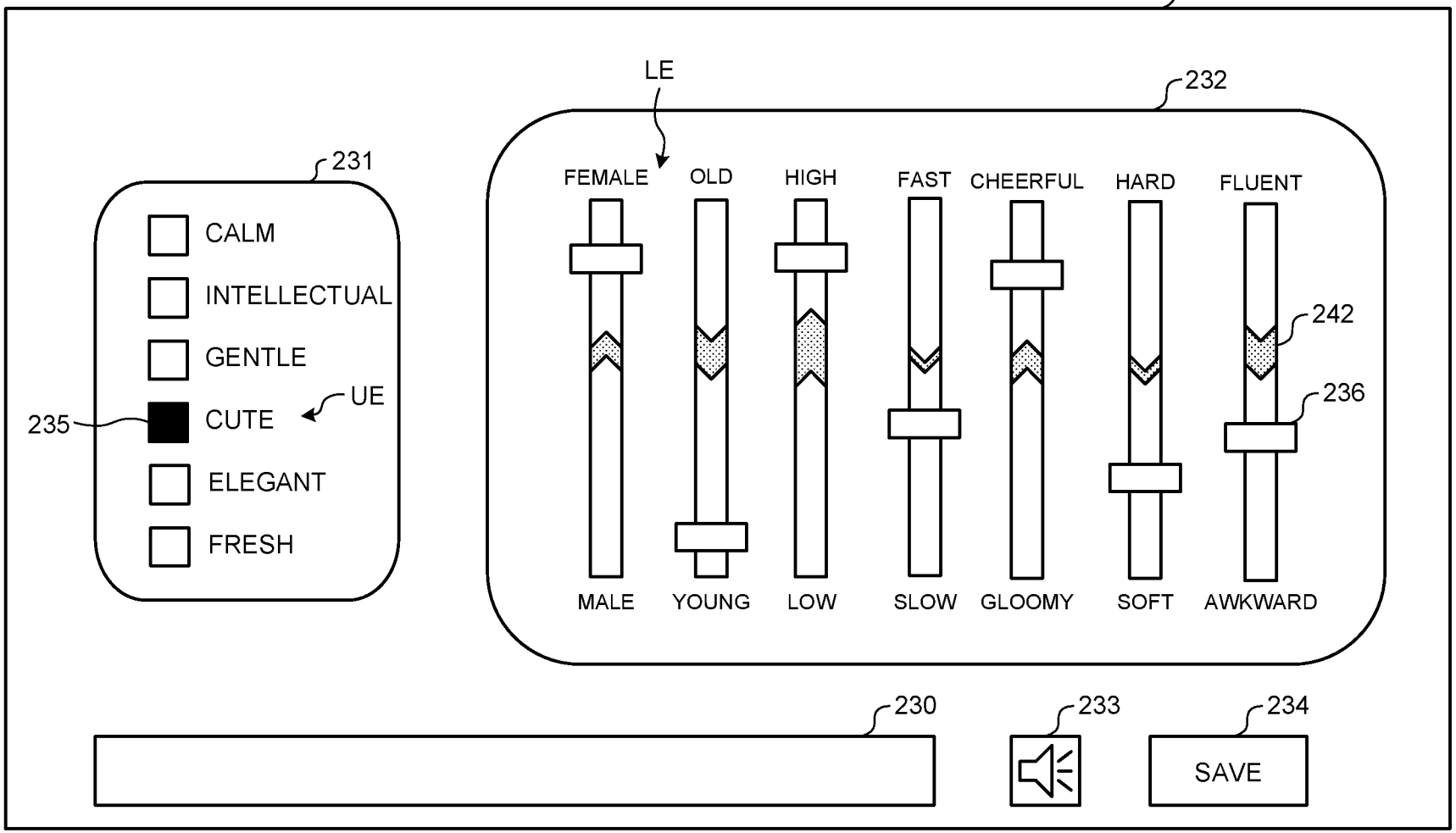
FIG. 21 is a schematic illustrating an example of the edit screen.

FIG. 21 is a schematic illustrating an example of the edit screen ES according to the present embodiment. FIG. 21 illustrates an example where the first operation to select the check box 235 of "cute" is performed on the first area 231 similarly to the edit screen ES illustrated in FIG. 6. The edit screen ES in FIG. 21 is different from the edit screen ES in FIG. 6 as follows: the control direction and the control magnitude to enhance the characteristics of the voice quality ("cute" in this example) specified by the first operation are exhibited in the second area 232 by arrow marks 242 such that the user can visually grasp them. The direction of the arrow marks 242 corresponds to the control direction, whereas the length thereof corresponds to the control magnitude. The control direction and the control magnitude represented by the arrow marks 242 indicate the correlation of the respective lower level expressions LE with the upper level expression UE. Specifically, the lower level expression LE having the arrow mark 242 pointing upward positively correlates with the upper level expression UE indicating the voice quality specified by the first operation. By contrast, the lower level expression LE having the arrow mark 242 pointing downward negatively correlates with the upper level expression UE indicating the voice quality specified by the first operation. As the length of the arrow mark 242 increases, the lower level expression LE highly correlates with the upper level expression UE. In the example of the edit screen ES illustrated in FIG. 21, the edit screen ES enables the user to intuitively grasp that a cute voice highly positively correlates with a high voice and that a cuter voice is a higher voice, for example. To emphasize the cuteness, the user simply needs to move the knob 236 of the slider bar along the arrow mark 242.

Figure 22:
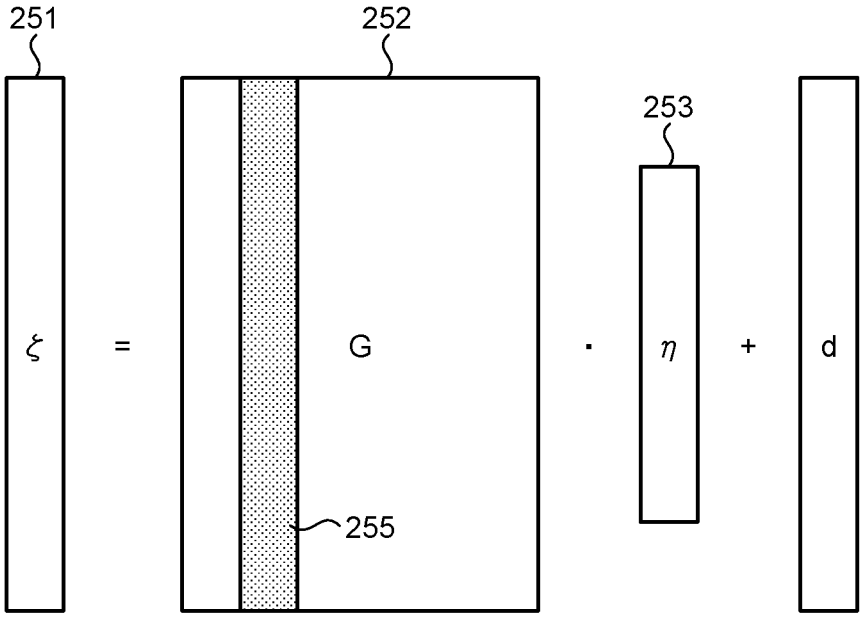
FIG. 22 is a diagram schematically illustrating a transformation equation (2)

To calculate the control direction and the control magnitude, the direction calculating unit 150 can use the transformation matrix in the score transformation model retained in the score transformation model storage unit 109, that is, the transformation matrix G in Equation (2) without any change. FIG. 22 is a diagram schematically illustrating the transformation equation (2). A transformation matrix G252 transforms an upper level expression score vector $\eta$253 into a lower level expression score vector $\xi$251. The number of rows of the transformation matrix G252 is equal to the number of lower level expressions LE, whereas the number of columns thereof is equal to the number of upper level expressions UE. By extracting a specific column 255 from the transformation matrix G252, the direction calculating unit 150 can obtain a correlation vector indicating the direction and the magnitude of correlation between a specific upper level expression UE and the lower level expressions LE. If these values are positive, the lower level expressions LE are assumed to positively correlate with the upper level expression UE. By contrast, if these values are negative, the lower level expressions LE are assumed to negatively correlate with the upper level expression UE. Absolute values of the values indicate the magnitude of correlation. The direction calculating unit 150 calculates these values as the control direction and the control magnitude, and the display control unit 111 generates and displays the arrow marks 242 on the edit screen ES illustrated in FIG. 21.

As described above, the first operation is assumed to be performed on the first area 231 of an option format illustrated in FIG. 21. The direction calculating unit 150, however, can calculate the control direction and the control magnitude in the same manner as those of the above examples in a case where the first operation to specify the voice quality is performed using the first area 231 of a slider bar format illustrated in FIG. 7, a dial format illustrated in FIG. 8, a radar chart format illustrated in FIG. 9, and other formats. In a case where a plurality of upper level expressions UE are specified, the direction calculating unit 150 simply needs to add up correlation vectors calculated between the respective upper level expressions UE and the lower level expressions LE.

As described above, the voice synthesizing device 100 according to the present embodiment exhibits, to the user, the control direction and the control magnitude to enhance the characteristics of the voice quality specified by the first operation. The voice synthesizing device 100 thus enables the user to generate various types of voice qualities more intuitively.

While the present embodiment describes a method for calculating the control direction and the control magnitude to enhance the characteristics of the voice quality specified by the first operation using the transformation matrix of the score transformation model, for example, the method for calculating the control direction and the control magnitude is not limited thereto. Alternatively, the present embodiment may employ a method of calculating a correlation coefficient between a vector in the direction of the column 222 in the score data of the upper level expressions UE illustrated in FIG. 5 and a vector in the direction of the row 211 in the score data of the lower level expressions LE illustrated in FIG. 4, for example. In this case, the sign of the correlation coefficient corresponds to the control direction, and the magnitude thereof corresponds to the control magnitude. While the present embodiment represents the control direction and the control magnitude with the arrow marks 242, the way of representation is not limited thereto. Any way of representation may be employed as long as it can exhibit the control direction and the control magnitude to the user such that he/she can visually grasp them.

Fourth Embodiment

A fourth embodiment is described below. The voice synthesizing device 100 according to the present embodiment is obtained by adding a function to assist voice quality editing by a method different from those of the second and the third embodiments to the voice synthesizing device 100 according to the first embodiment. Specifically, the voice synthesizing device 100 according to the present embodiment has a function to calculate the controllable range similarly to the second embodiment and a function to randomly set values within the controllable range based on the second operation. Components common to those of the first and the second embodiments are denoted by common reference numerals, and overlapping explanation thereof is appropriately omitted. The following describes characteristic parts of the fourth embodiment.

Figure 23:
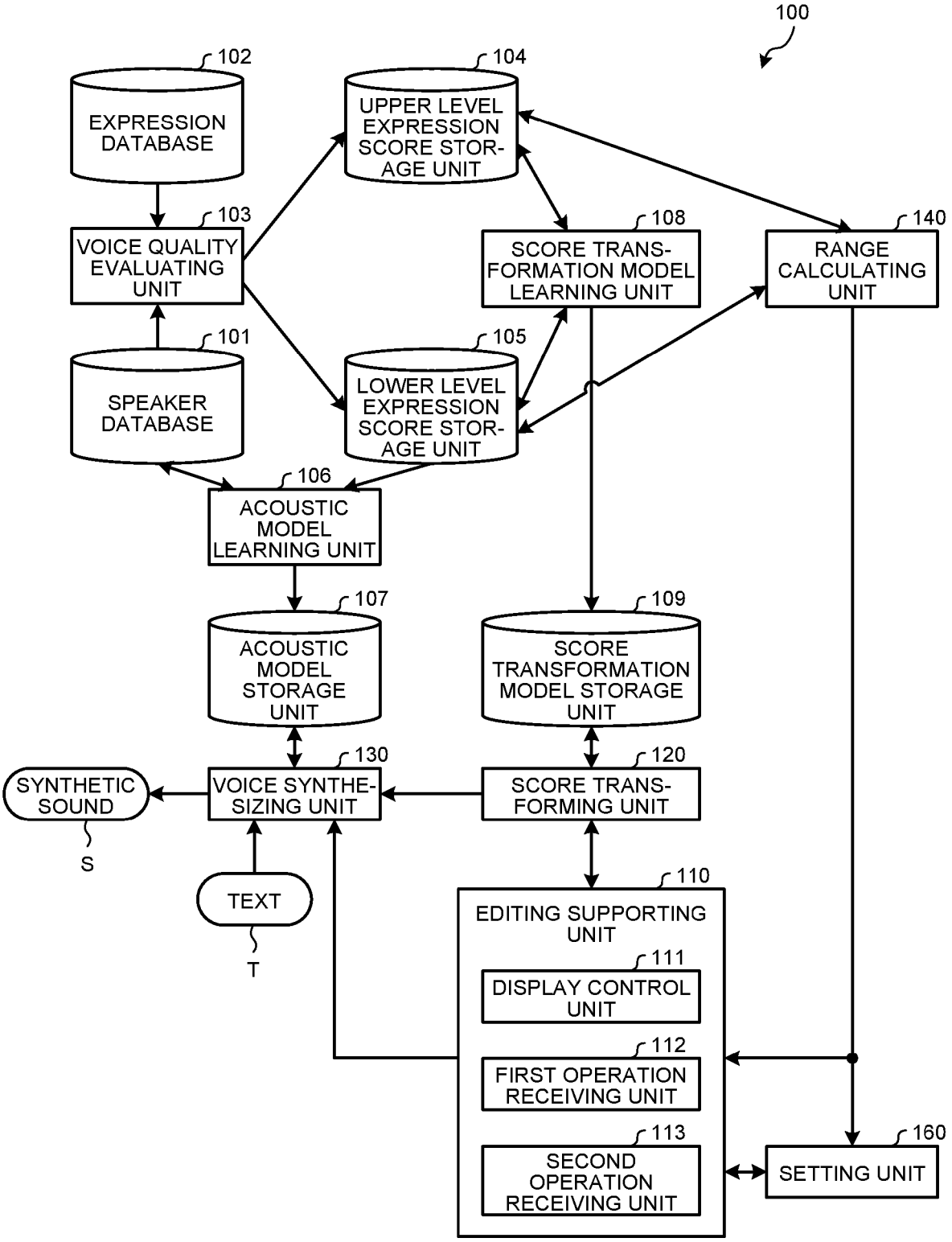
FIG. 23 is a block diagram illustrating an exemplary functional configuration of the voice synthesizing device according to a fourth embodiment.

FIG. 23 is a block diagram illustrating an exemplary functional configuration of the voice synthesizing device 100 according to the fourth embodiment. As illustrated in FIG. 23, the voice synthesizing device 100 according to the present embodiment has a configuration obtained by adding the range calculating unit 140 and a setting unit 160 to the voice synthesizing device 100 according to the first embodiment (see FIG. 1).

The range calculating unit 140 calculates the controllable range that can maintain the characteristics of the voice quality specified by the first operation similarly to the second embodiment. The controllable range calculated by the range calculating unit 140 is transmitted to the editing supporting unit 110 and the setting unit 160.

The setting unit 160 randomly sets the scores of the lower level expressions LE based on the second operation within the controllable range calculated by the range calculating unit 140. The second operation is not an operation of moving the knobs 236 of the slider bars described above but a simple operation of pressing a generation button 260 illustrated in FIGS. 24A and 24B, for example.

Figure 24A:
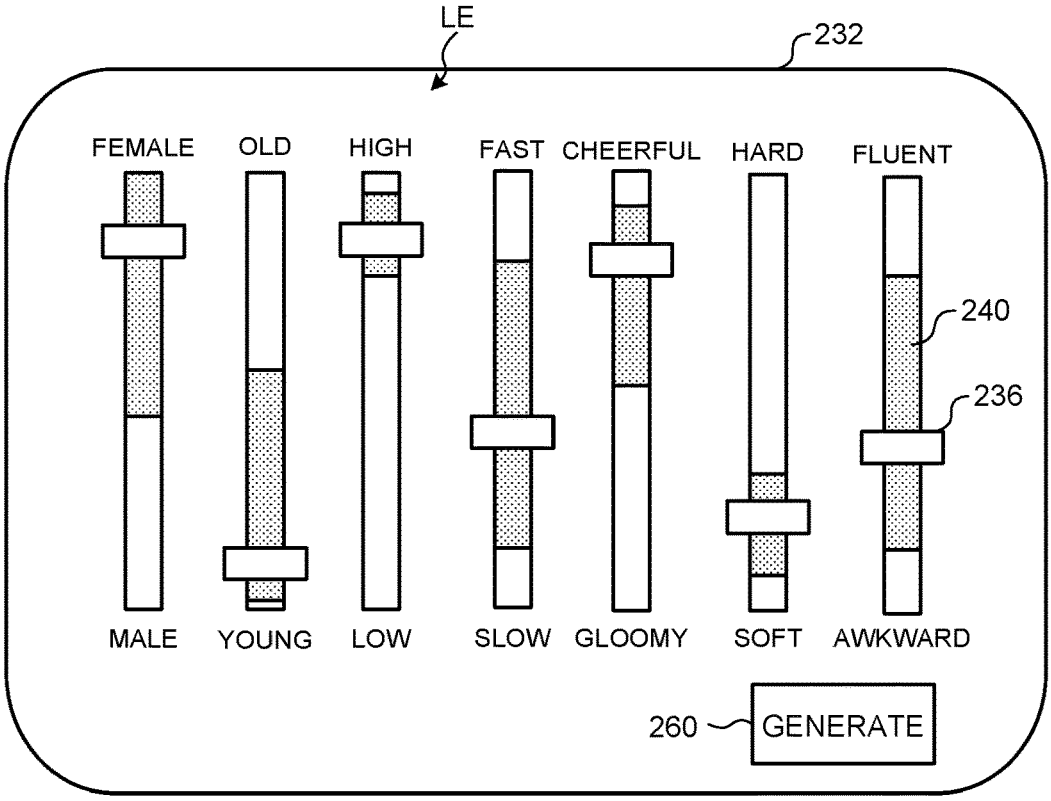
FIGS. 24A and 24B are schematics illustrating an example of the edit screen.
Figure 24B:
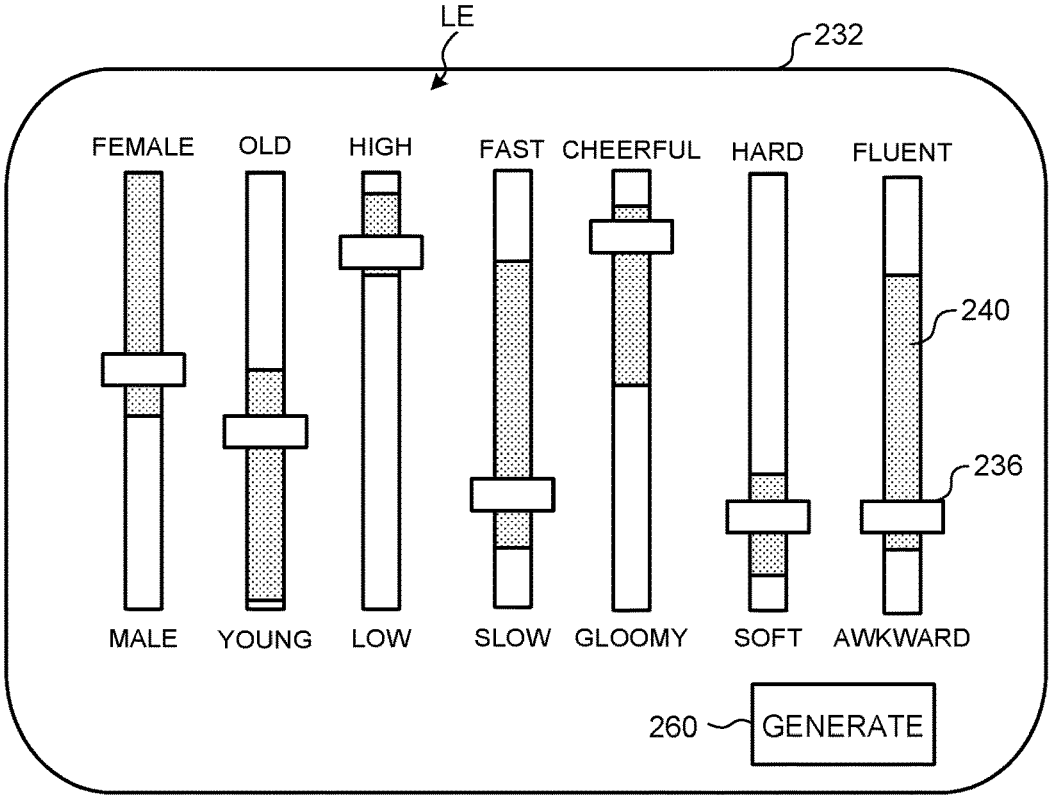

FIGS. 24A and 24B are schematics illustrating an example of the second area 232 in the edit screen ES according to the present embodiment. The second area 232 illustrated in FIGS. 24A and 24B is different from the second area 232 in the edit screen ES illustrated in FIG. 16 in that it includes the generation button 260. When the user operates the generation button 260 on the second area 232 illustrated in FIG. 24A, for example, the setting unit 160 randomly sets the scores of the respective lower level expressions LE within the controllable range calculated by the range calculating unit 140, thereby changing the lower level expression score vector. As a result, the second area 232 is updated as illustrated in FIG. 24B. The second area 232 illustrated in FIGS. 24A and 24B exhibits the controllable range to the user with the strip-shaped marks 240 similarly to the second embodiment. The second area 232, however, does not necessarily exhibit the controllable range to the user and may include no strip-shaped mark 240.

As described above, the voice synthesizing device 100 according to the present embodiment randomly sets, based on the simple second operation of pressing the generation button 260, the values of the lower level expressions LE within the controllable range that can maintain the characteristics of the voice quality specified by the first operation. The voice synthesizing device 100 thus enables the user to obtain a randomly synthesized sound having a desired voice quality by a simply operation.

SUPPLEMENTARY EXPLANATION

While the voice synthesizing device 100 described above is configured to have both of a function to learn an acoustic model and a score transformation model and a function to generate a synthetic sound using the acoustic model and the score transformation model, it may be configured to have no function to learn an acoustic model or a score transformation model. In other words, the voice synthesizing device 100 according to the embodiments above may include at least the editing supporting unit 110, the score transforming unit 120, and the voice synthesizing unit 130.

Figure 25:
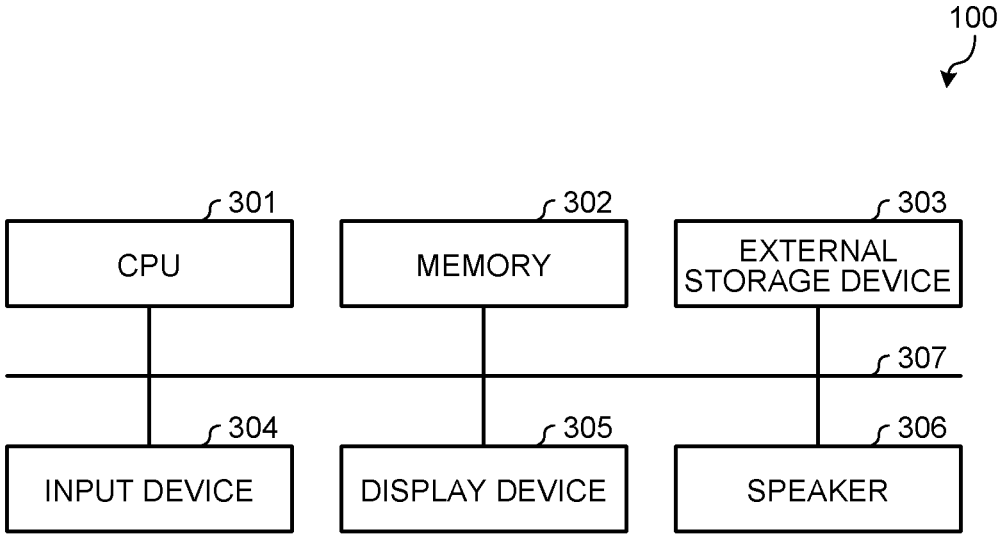
FIG. 25 is a block diagram illustrating an exemplary hardware configuration of the voice synthesizing device.

The voice synthesizing device 100 according to the embodiments above can be provided by a general-purpose computer serving as basic hardware, for example. FIG. 25 is a block diagram illustrating an exemplary hardware configuration of the voice synthesizing device 100. In the example illustrated in FIG. 25, the voice synthesizing device 100 includes a memory 302, a CPU 301, an external storage device 303, a speaker 306, a display device 305, an input device 304, and a bus 307. The memory 302 stores therein a computer program that performs a voice synthesis, for example. The CPU 301 controls the units of the voice synthesizing device in accordance with computer programs in the memory 302. The external storage device 303 stores therein various types of data required to control the voice synthesizing device 100. The speaker 306 outputs a synthetic sound, for example. The display device 305 displays the edit screen ES. The input device 304 is used by the user to operate the edit screen ES. The bus 307 connects the units. The external storage device 303 may be connected to the units via a wired or wireless local area network (LAN), for example.

Instructions relating to the processing described in the embodiments above are executed based on a computer program serving as software, for example. The instructions relating to the processing described in the embodiments above are recorded in a recording medium, such as a magnetic disk (e.g., a flexible disk and a hard disk), an optical disc (e.g., a CD-ROM, a CD-R, a CD-RW, a DVD-ROM, a DVD±R, a DVD±RW, and a Blu-ray (registered trademark) Disc), and a semiconductor memory, as a computer program executable by a computer. The recording medium may have any storage form as long as it is a computer-readable recording medium.

The computer reads the computer program from the recording medium and executes the instructions described in the computer program by the CPU 301 based on the computer program. As a result, the computer functions as the voice synthesizing device 100 according to the embodiments above. The computer may acquire or read the computer program via a network.

Part of the processing to provide the embodiments above may be performed by an operating system (OS) operating on the computer based on the instructions in the computer program installed from the recording medium to the computer, database management software, and middleware (MW), such as a network, and other components.

The recording medium according to the embodiments above is not limited to a medium independent of the computer. The recording medium may store or temporarily store therein a computer program by downloading and transmitting it via a LAN, the Internet, or the like to the computer.

The number of recording media is not limited to one. The recording medium according to the present invention may be a plurality of media with which the processing according to the embodiments above is performed. The media may be configured in any form.

The computer program executed by the computer has a module configuration including the processing units (at least the editing supporting unit 110, the score transforming unit 120, and the voice synthesizing unit 130) constituting the voice synthesizing device 100 according to the embodiments above. In actual hardware, the CPU 301 reads and executes the computer program from the memory 302 to load the processing units on a main memory. As a result, the processing units are generated on the main memory.

The computer according to the embodiments above executes the processing according to the embodiments above based on the computer program stored in the recording medium. The computer may be a single device, such as a personal computer and a microcomputer, or a system including a plurality of devices connected via a network, for example. The computer according to the embodiments above is not limited to a personal computer and may be an arithmetic processing unit or a microcomputer included in an information processor, for example. The computer according to the embodiments above collectively means devices and apparatuses that can provide the functions according to the embodiments above based on the computer program.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A voice synthesizing device comprising:

a first operation receiving unit configured to receive a first user operation specifying voice quality of a desired voice based on one or more upper level expressions;

a score transforming unit configured to transform a score vector of the upper level-expressions corresponding to the first user operation into a score vector of one or more lower level expressions that are closer to parameters of an acoustic model than the upper level expressions are to the parameters;

a second operation receiving unit configured to receive a second user operation to change the score vector of the lower level expressions resulting from the transformation; and a voice synthesizing unit configured to generate a synthetic sound corresponding to a certain text based on the score vector of the lower level expressions resulting from transformation, wherein when the second user operation is received by the second operation receiving unit, the voice synthesizing unit generates the synthetic sound based on the score vector of the lower level expressions changed based on the second user operation.

2. The voice synthesizing device according to claim 1, further comprising a display control unit configured to cause a display device to display an edit screen that exhibits a score of a lower level expression that is an element of the score vector of the lower level expressions resulting from the transformation and receives the second user operation, wherein the second operation receiving unit receives the second user operation input on the edit screen.

3. The voice synthesizing device according to claim 2, further comprising a range calculating unit configured to calculate a range of the score of the lower level expression capable of maintaining a characteristic of the voice quality specified by the first user operation, wherein the display control unit causes the display device to display the edit screen that exhibits the score of the lower level expression together with the range.

4. The voice synthesizing device according to claim 2, further comprising a direction calculating unit configured to calculate a direction of changing the score of the lower level expression so as to enhance a characteristic of the voice quality specified by the first user operation and a degree of enhancement, wherein the display control unit causes the display device to display the edit screen that exhibits the score of the lower level expression together with the direction and the degree of enhancement.

5. The voice synthesizing device according to claim 2, further comprising a range calculating unit configured to calculate a range of the score of the lower level expression capable of maintaining a characteristic of the voice quality specified by the first user operation; and a setting unit configured to randomly set the score of the lower level expression within the range based on the second user operation.

6. The voice synthesizing device according to claim 2, wherein the display control unit causes the display device to display the edit screen including a first area that receives the first user operation and a second area that exhibits a score of the lower level expression that is an element of the score vector of the lower level expressions resulting from the transformation and that receives the second user operation, the first operation receiving unit receives the first user operation input on the first area, and the second operation receiving unit receives the second user operation input on the second area.

7. The voice synthesizing device according to claim 1, wherein the voice synthesizing unit generates the synthetic sound corresponding to the score vector of the lower level expressions resulting from the transformation using the acoustic model.

8. The voice synthesizing device according to claim 1, further comprising a model storage unit configured to retain a score transformation model that is used for transforming a score vector of one or more upper level expressions into a score vector of one or more lower level expressions, wherein the score transforming unit transforms the score vector of the upper level expressions corresponding to the first user operation into the score vector of the lower level expressions based on the score transformation model retained in the model storage unit.

9. The voice synthesizing device according to claim 1, wherein the score transformation model is a statistical model obtained by learning using, as learning data, a score vector of one or more upper level expressions and a score vector of one or more lower level expressions acquired as a result of evaluation of a certain voice.

10. The voice synthesizing device according to claim 9, further comprising a model learning unit configured to learn the score transformation model, using the score vector of the upper level expressions and the score vector of the lower level expressions acquired as the result of evaluation of the certain voice, as the learning data.

11. The voice synthesizing device according to claim 1, wherein the upper level expressions include at least one of calm, intellectual, gentle, cute, elegant, and fresh.

12. A voice synthesizing method performed by a voice synthesizing device, the voice synthesizing method comprising:

receiving a first user operation specifying voice quality of a desired voice based on one or more upper level expressions;

transforming a score vector of the upper level expressions corresponding to the first user operation into a score vector of one or more lower level expressions that are closer to parameters of an acoustic model than the upper level expressions are to the parameters; and generating a synthetic sound corresponding to a certain text based on the score vector of the lower level expressions resulting from transformation, wherein when a second user operation to change the score vector of the lower level expressions resulting from the transformation is received, the generating generates the synthetic sound based on the score vector of the lower level expressions changed based on the second user operation.

13. The voice synthesizing method according to claim 12, wherein the upper level expressions include at least one of calm, intellectual, gentle, cute, elegant, and fresh.

14. A computer program product having a non-transitory computer readable medium including programmed instructions, wherein the instructions, when executed by a computer, cause the computer to perform:

a function of receiving a first user operation specifying voice quality of a desired voice based on one or more upper level expressions;

a function of transforming a score vector of the upper level expressions corresponding to the first user operation into a score vector of one or more lower level expressions that are closer to parameters of an acoustic model than the upper level expressions are to the parameters;

a function of receiving a second user operation to change the score vector of the lower level expressions resulting from the transformation; and a function of generating a synthetic sound corresponding to a certain text based on the score vector of the lower level expressions resulting from transformation, wherein when the second user operation is received, the function of generating the synthetic sound generates the synthetic sound based on the score vector of the lower level expressions changed based on the second user operation.

15. The computer program product according to claim 14, wherein the upper level expressions include at least one of calm, intellectual, gentle, cute, elegant, and fresh.

* * * * *